US007783225B2

(12) United States Patent
Fujiwara

(10) Patent No.: US 7,783,225 B2
(45) Date of Patent: Aug. 24, 2010

(54) IMAGE FORMING APPARATUS AND PHOTOSENSITIVE DRUM UNIT EQUIPPED WITH MOUNTING MECHANISM OF EXPOSURE MEANS

(75) Inventor: Daisuke Fujiwara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 1982 days.

(21) Appl. No.: 10/760,536

(22) Filed: Jan. 21, 2004

(65) Prior Publication Data

US 2004/0228652 A1 Nov. 18, 2004

(30) Foreign Application Priority Data

Jan. 21, 2003 (JP) ..... 2003-012135

(51) Int. Cl.
*G03G 15/00* (2006.01)

(52) U.S. Cl. ..... 399/107; 399/113; 399/117; 347/138

(58) Field of Classification Search ..... 399/113, 399/112, 111, 110, 107, 117; 347/138
See application file for complete search history.

(56) References Cited

U.S. PATENT DOCUMENTS 4,743,927 A * 5/1988 Sasaki ..... 347/130
5,475,484 A * 12/1995 Kimura ..... 399/130
5,752,133 A * 5/1998 Nagase et al. ..... 399/112
5,946,523 A * 8/1999 Fujioka et al. ..... 399/49
6,006,058 A 12/1999 Watanabe et al.
6,029,032 A 2/2000 Watanabe et al.
6,169,866 B1 1/2001 Watanabe et al.
6,324,363 B1 11/2001 Watanabe et al.
6,330,409 B1 12/2001 Watanabe et al.
2002/0149664 A1 * 10/2002 Nagamine et al. ..... 347/138

FOREIGN PATENT DOCUMENTS

JP 5-15051 2/1993
JP 8-30175 2/1996
JP 10-153937 6/1998

* cited by examiner

*Primary Examiner*—David M Gray
*Assistant Examiner*—G. M. Hyder
(74) *Attorney, Agent, or Firm*—Smith, Gambrell & Russell, LLP

(57) ABSTRACT

An image forming apparatus comprising a pair of stationary side walls arranged in an image forming apparatus body and a plurality of photosensitive drum units supported between the stationary side walls. Each photosensitive drum unit comprises a drum-holding frame for holding a photosensitive drum, a head-holding frame for holding an LED head, and a pressing means for pressing the head-holding frame from one side toward the other side in the axial direction of the photosensitive drum.

16 Claims, 12 Drawing Sheets

216
215
208
202
206
215a
244
204
(a)
28
240
230
100
14
(b)
16
206
202
12
27
100
14
(c)
202
206
204
240
12
100
14
204
240
12

(a)

(b)

IMAGE FORMING APPARATUS AND PHOTOSENSITIVE DRUM UNIT EQUIPPED WITH MOUNTING MECHANISM OF EXPOSURE MEANS

FIELD OF THE INVENTION

The present invention relates to an electrostatic image forming apparatus such as a printer, a copier or a facsimile. More specifically, the invention relates to an image forming apparatus (particularly, tandem-type color image forming apparatus) comprising a pair of stationary side walls arranged in an image forming apparatus body and a plurality of photosensitive drum units supported between the stationary side walls, and to a photosensitive drum unit applied to the image forming apparatus.

DESCRIPTION OF THE RELATED ART

In an electrostatic image forming apparatus such as a printer, a copier or a facsimile, an electrostatic latent image or the like is formed on a photosensitive material, developed into a toner image through a developing device, the toner image is transferred onto a recording paper directly or through an intermediate transfer belt which is a to-be-transferred member, and the transferred image is fixed to obtain a desired record. In recent years, there have been widely used color image-forming apparatuses such as color printers and color copiers, and studies to speed up their operation are under way. As for a system for realizing a color image forming apparatus that operates at high speeds, attention has been given to a so-called tandem-type color image forming apparatus in which a plurality of photosensitive drum units are arranged. Further, in the tandem-type color image forming apparatus, an LED head that requires a relatively compact space for installation is often used as an exposure means. The LED head is constituted by an LED array, a rod lens array and a frame for holding them.

In the tandem-type color image forming apparatus equipped with a plurality of photoconductor units, the exposure means in the photoconductor units must be mounted at positions aligned with each other in the axial direction of the photosensitive drums relative to an intermediate transfer belt that is a to-be-transferred member. Otherwise, a problem occurs that the color image has a color drift. When the LED head is used as the exposure means, further, the depth of a focal point of the rod lens array is shallow. Therefore, there arises a problem with adjustment of the focal point to the peripheral surface of the photosensitive drum, on which the image is to be formed.

There has been known an image forming apparatus of a type in which the LED head is supported by the frame of the photosensitive drum unit (see Japanese Unexamined Utility Model Publication (Kokai) No. 5-15051). In the image forming apparatus disclosed in the above publication, the photosensitive drum unit has a pair of side frames. Photosensitive drums are supported between the side frames so as to freely rotate. Leg portions are formed at both end portions of the LED head, and a positioning hole is formed in each of the leg portions. A placing table is provided for each of the side frames integrally therewith, the placing table having a projection erected upright. Each side frame has a stepped portion formed integrally therewith so as to be mounted on the apparatus body. The legs of the LED head are each placed on the placing tables of the corresponding side frames, and the positioning holes formed in the leg portions of the LED head are fitted to the projections formed on the placing tables. The photosensitive drum unit having the LED head that is thus installed on the side frames is mounted on a predetermined position of the apparatus body by utilizing the stepped portions formed on each of the side frames.

In the thus constituted image forming apparatus, the positional precision of the LED head in the axial direction of the photosensitive drum varies depending upon the precision in the mounting position of the photosensitive drum unit and hence, fluctuation is liable to occur in the positional precision due to tolerance of building-up of parts. When the image forming apparatus is a tandem-type color image forming apparatus, consequently, fluctuation easily occurs in the precision of the mounting position of the LED head between the photosensitive drum units in the axial direction of the photosensitive drum, and color drift is very likely to occur in the color image.

On the other hand, the position in the radial direction relative to the peripheral surface of the photosensitive drum, of the LED head varies depending upon the precision of mounting the leg portions of the LED head on the placing tables of the corresponding side frames and hence, fluctuation easily occurs. As a result, precision in the mounting position in the radial direction relative to the peripheral surface of the photosensitive drum, in other words, precision in the focal point, of the LED head is not maintained as desired, and sharp image may not be guaranteed.

SUMMARY OF THE INVENTION

It is an object of the present invention to provide a novel image forming apparatus equipped with photosensitive drum units, which enables to improve precision in the mounting position in the axial direction of the photosensitive drum, of an exposure means; and a photosensitive drum unit applied to the above image forming apparatus.

It is another object of the present invention to provide a novel image forming apparatus equipped with photosensitive drum units, which enables to improve precision in the mounting position in the axial direction relative to the peripheral surface of the photosensitive drum, of an exposure means; and a photosensitive drum unit applied to the above image forming apparatus.

It is a further object of the present invention to provide a novel image forming apparatus equipped with photosensitive drum units, which can improve precision in the mounting position in the axial direction of the photosensitive drum, of an exposure means and precision in the mounting position in the radial direction relative to the peripheral surface of the photosensitive drum, of an exposure means, simultaneously; and a photosensitive drum unit applied to the above imaging forming apparatus.

According to one aspect of the present invention, there is provided an image forming apparatus comprising a pair of stationary side walls arranged in an image forming apparatus body and a plurality of photosensitive drum units supported between the stationary side walls, wherein each of the photosensitive drum units comprises a drum-holding frame for holding a photosensitive drum, an exposure means-holding frame for holding the exposure means, and a pressing means for pressing the exposure means-holding frame from one side toward the other side in the axial direction of the photosensitive drum.

It is desired that the pressing means is disposed on one side of the drum-holding frame so as to press the exposure means-holding frame from one side toward the other side in the axial direction of the photosensitive drum.

It is desired that the pressing means is pushed upon coming in contact with one stationary side wall and a part on the other side of the exposure means-holding frame is press-contacted to the other stationary side wall, so that the exposure means-holding frames are aligned to each other at predetermined positions in an axial direction with the other stationary side wall as a reference.

It is desired that the exposure means-holding frame is supported so as to move in the axial direction relative to the drum-holding frame by fitting the shafts or the fitting holes disposed on both side walls that define both sides of the exposure means-holding frame to the fitting holes or the shafts disposed on both side walls of the drum-holding frame, and axes of the shafts or the fitting holes disposed on both side walls of the exposure means-holding frame and the axes of the fitting holes or the shafts disposed on both side walls of the drum-holding frame, are arranged on a common imaginary axis line in parallel with the axis of the photosensitive drum, which is on a common imaginary axis line on the peripheral surface, on which an image is focused by the exposure means, of the photosensitive drum.

It is desired that first positioning projections are disposed on both side walls of the drum-holding frame and having axes common to the axis of the photosensitive drum, second positioning projections are disposed on both side walls of the exposure means-holding frame in parallel with the axis of the photosensitive drum, and a first positioning groove and a second positioning groove are formed in the stationary side walls for positioning the first positioning projection and the second positioning projection that are inserted therein.

It is desired that the first positioning projections disposed on both side walls of the drum-holding frame are constituted by the shaft of the photosensitive drum.

It is desired that the second positioning projection disposed on the other side wall of the exposure means-holding frame is constituted by a positioning/pushing shaft, positioning surface walls are formed substantially integrally with the stationary side walls on the outer sides of the regions of the stationary side walls where the second positioning grooves are formed, and as the first positioning projections are inserted in the first positioning grooves and as the second positioning projections are inserted in the second positioning grooves thereby enabling the photosensitive drum units to be supported at predetermined positions between the stationary side walls, the pressing means is pushed upon coming in contact with the positioning wall surface of the one stationary side wall, and the front end surface of the positioning/pushing shaft of the exposure means-holding frame is pushed onto the positioning wall surface of the other stationary side wall due to the pressing means.

It is desired that the exposure means-holding frame has a side wall for defining one side of the exposure means-holding frame, the drum-holding frame has one side wall for defining one side of the drum-holding frame, which is positioned on the outer side of one side wall of the exposure means-holding frame, the pressing means comprises a cap-shaped pressing member disposed on one side wall of the drum-holding frame so as to move in the axial direction and a compression coil spring disposed between the pressing member and the one side wall of the exposure means-holding frame, the pressing member is so disposed as to protrude beyond one side wall of the drum-holding frame and is limited at a predetermine position from moving in a direction to separate away from one side wall of the exposure means-holding frame, and, in a state where the photosensitive drum units are supported at predetermined positions between the stationary side walls, the pressing member is pushed upon being contacted to one stationary side wall and, upon bringing part on the other side of the exposure means-holding frame into pressed contact with the other stationary side wall, the exposure means-holding frames are aligned to each other, at predetermined positions in an axial direction, with the other stationary side wall as a reference.

It is desired that the exposure means is held by the exposure means-holding frame so as to adjust the position thereof in the radial direction relative to the peripheral surface of the photosensitive drum.

It is desired that both side portions of the exposure means are supported by the exposure means-holding frame via a radial direction position adjusting means capable of adjusting the positions thereof in the radial direction relative to the peripheral surface of the photosensitive drum.

It is desired that each of the radial direction position adjusting means includes fitting holes formed in the bottom wall portions disposed integrally in the inside of both side portions of the exposure means-holding frame, the fitting holes being such that the ends thereof on the bottom wall side are closed by the closing walls and the other ends thereof are opened, cylindrical portions formed integrally on both side portions of the exposure means and being internally threaded along the inner peripheral surfaces thereof, the cylindrical portions being inserted in the fitting holes from the other ends thereof so as to slide, radial direction position adjusting bolts brought into engagement with the cylindrical portions and into contact at the front ends thereof with the closing walls in the bottom wall portions, and a spring means for urging both side portions of the exposure means toward the bottom wall portions, wherein the fitting holes are so positioned that the axes thereof extend in parallel with each other and at right angles with the axis of the photosensitive drum.

It is desired that the exposure means comprises an LED head.

According to another aspect of the present invention, there is provided a photosensitive drum unit supported between a pair of stationary side walls disposed in the image forming apparatus body, which comprises a drum-holding frame for holding a photosensitive drum, an exposure means-holding frame for holding an exposure means, and a pressing means capable of pressing the exposure means-holding frame from one side toward the other side in the axial direction of the photosensitive drum.

It is desired that the pressing means is disposed on one side of the drum-holding frame so as to press the exposure means-holding frame from one side toward the other side in the axial direction of the photosensitive drum.

It is desired that the exposure means-holding frame has one side wall for defining one side of the exposure means-holding frame; the drum-holding frame has a side wall for defining one side of the drum-holding frame, which is positioned on the outer side of one side wall of the exposure means-holding frame, the pressing means comprises a cap-shaped pressing member disposed on one side wall of the drum-holding frame so as to move in the axial direction and a compression coil spring disposed between the pressing member and the one side wall of the exposure means-holding frame, and the pressing member is so disposed as to protrude beyond one side wall of the drum-holding frame and is limited at a predetermine position from moving in a direction to separate away from one side wall of the exposure means-holding frame.

It is desired that the exposure means-holding frame is supported so as to move in the axial direction relative to the drum-holding frame by fitting the shafts or the fitting holes disposed on both side walls that define both sides of the exposure means-holding frame to the fitting holes or the shafts disposed on both side-walls of the drum-holding frame, and axes of the shafts or the fitting holes disposed on both side walls of the exposure means-holding frame and the axes of the fitting holes or the shafts disposed on both side walls of the drum-holding frame, are arranged on a common imaginary axis line in parallel with the axis of the photosensitive drum, which is on a common imaginary axis line on the peripheral surface where an image is focused by the exposure means, of the photosensitive drum.

It is desired that the exposure means is held by the exposure means-holding frame so as to adjust the position thereof in the radial direction relative to the peripheral surface of the photosensitive drum.

It is desired that both side portions of the exposure means are supported by the exposure means-holding frame via a radial direction position adjusting means capable of adjusting the positions thereof in the radial direction relative to the peripheral surface of the photosensitive drum.

It is desired that each of the radial direction position adjusting means comprises fitting holes formed in the bottom wall portions disposed integrally in the inside of both side portions of the exposure means-holding frame, the fitting holes being such that the ends thereof on the bottom wall side are closed by the closing walls and the other ends thereof are opened, cylindrical portions formed integrally on both side portions of the exposure means and being internally threaded along the inner peripheral surfaces thereof, the cylindrical portions being inserted in the fitting holes from the other ends thereof so as to slide, radial direction position adjusting bolts brought into engagement with the cylindrical portions and into contact at the front ends thereof with the closing walls in the bottom wall portions, and a spring means for urging both side portions of the exposure means toward the bottom wall portions, wherein the fitting holes are so positioned that the axes thereof extend in parallel with each other and at right angles with the axis of the photosensitive drum.

It is desired that the exposure means comprises an LED head.

BRIEF DESCRIPTION OF THE DRAWINGS

FIG. 11(*b*) is a perspective view illustrating the other side surface thereof.

DETAILED DESCRIPTION OF THE PREFERRED EMBODIMENTS

A preferred embodiment of an image forming apparatus equipped with photosensitive drum units constituted according to the present invention will now be described with reference to the accompanying drawings.

Figure 1:
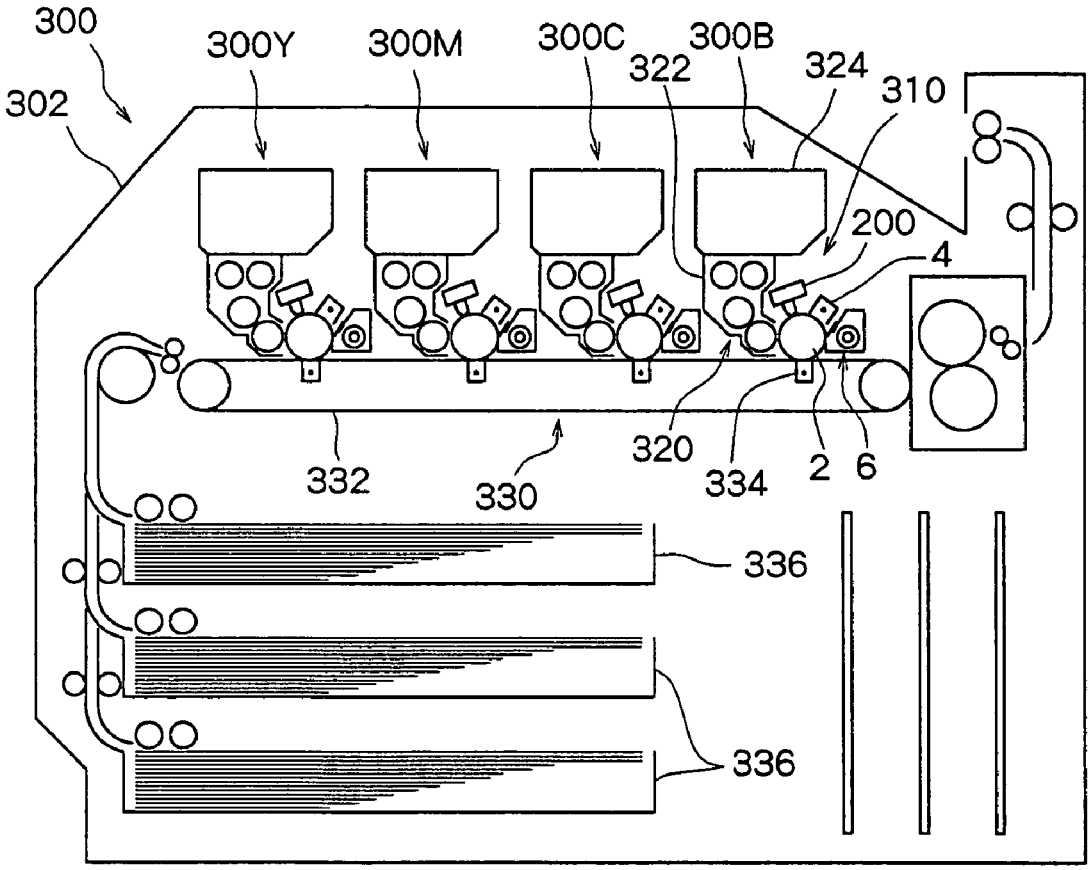
FIG. 1 is a constitution view schematically illustrating a tandem-type color image forming apparatus constituted according to an embodiment of the present invention.

FIG. 1 is a sectional view schematically illustrating the constitution of a tandem-type color image forming apparatus equipped with photosensitive drum unit s according to the present invention. The illustrated tandem-type color image forming apparatus 300 is provided with an image forming apparatus body 302 of nearly a rectangular parallelepiped shape. In the image forming apparatus body 302, there are arranged an image forming unit 300B for black, an image forming unit 300C for cyan, an image forming unit 300M for magenta and an image forming unit 300Y for yellow in this order from the right toward the left in FIG. 1. The image forming units 300B, 300C, 300M and 300Y are, respectively, provided with a photosensitive drum unit 310 and a developing unit 320 that will be described later. The photosensitive drum unit 310 is provided with a photosensitive drum 2, an LED head 200 which is an exposure means, a charging unit 4 and a cleaning unit 6. The developing unit 320 is provided with a developing unit 322 and a toner replenishing container 324. The toner replenishing containers 324 contain each toners of colors corresponding to the image forming units 300B, 300C, 300M and 300Y.

A conveyer belt mechanism 330 including a conveyer belt 332 is arranged on the lower side of the photosensitive drum units 310 and the developing units 320. A transfer unit 334 is arranged on the lower side of each of the photosensitive drums 2. The conveyer belt 332 is so arranged that part of the regions thereof move in nearly a horizontal direction passing through between the photosensitive drums 2 and the transfer units 334 facing thereto. The conveyer belt mechanism 330 works to convey the recording papers delivered from paper feed cassettes 336 arranged on the lower side thereof so as to pass through between the photosensitive drums 2 and the transfer units 334 facing thereto. The basic constitution of the tandem-type color image forming apparatus maybe constituted in a customary manner and does not pertain to the feature of the present invention, and hence, is not described here in further detail.

Next, described below in detail are the constitution of the photosensitive drum units 310 mounted on the image forming apparatus body 302 illustrated in FIG. 1 and mechanisms for mounting the photosensitive drum units 310 on the image forming apparatus body 302. The photosensitive drum units 310 and the mechanisms for mounting the photosensitive drum units 310 on the image-forming apparatus body 302, are constituted in substantially the same manner relative to one another.

Referring to FIGS. 4 to 8, the photosensitive drum unit 310 comprises a drum-holding frame 100 which holds the photosensitive drum 2 so as to freely rotate, and an exposure means-holding frame which holds the exposure means or, in this embodiment, an LED head 200 that forms an electrostatic latent image on the peripheral surface of the photosensitive drum 2 or, in this embodiment, an LED head-holding frame 202 (hereinafter simply referred to as "head-holding frame 202").

Figure 6:
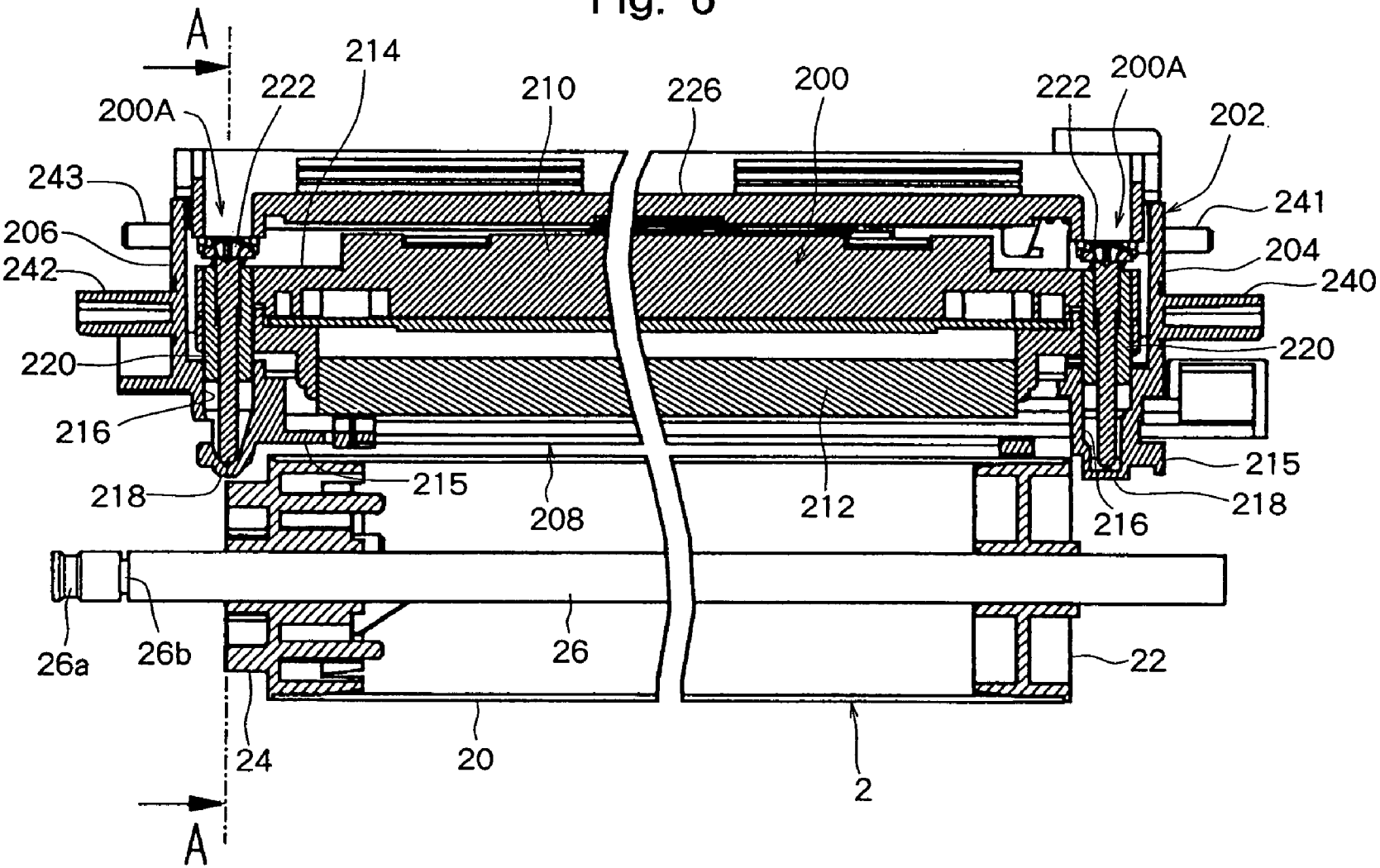
FIG. 6 is a vertical sectional view of a head-holding frame including an LED head and of the photosensitive drum.
Figure 7:
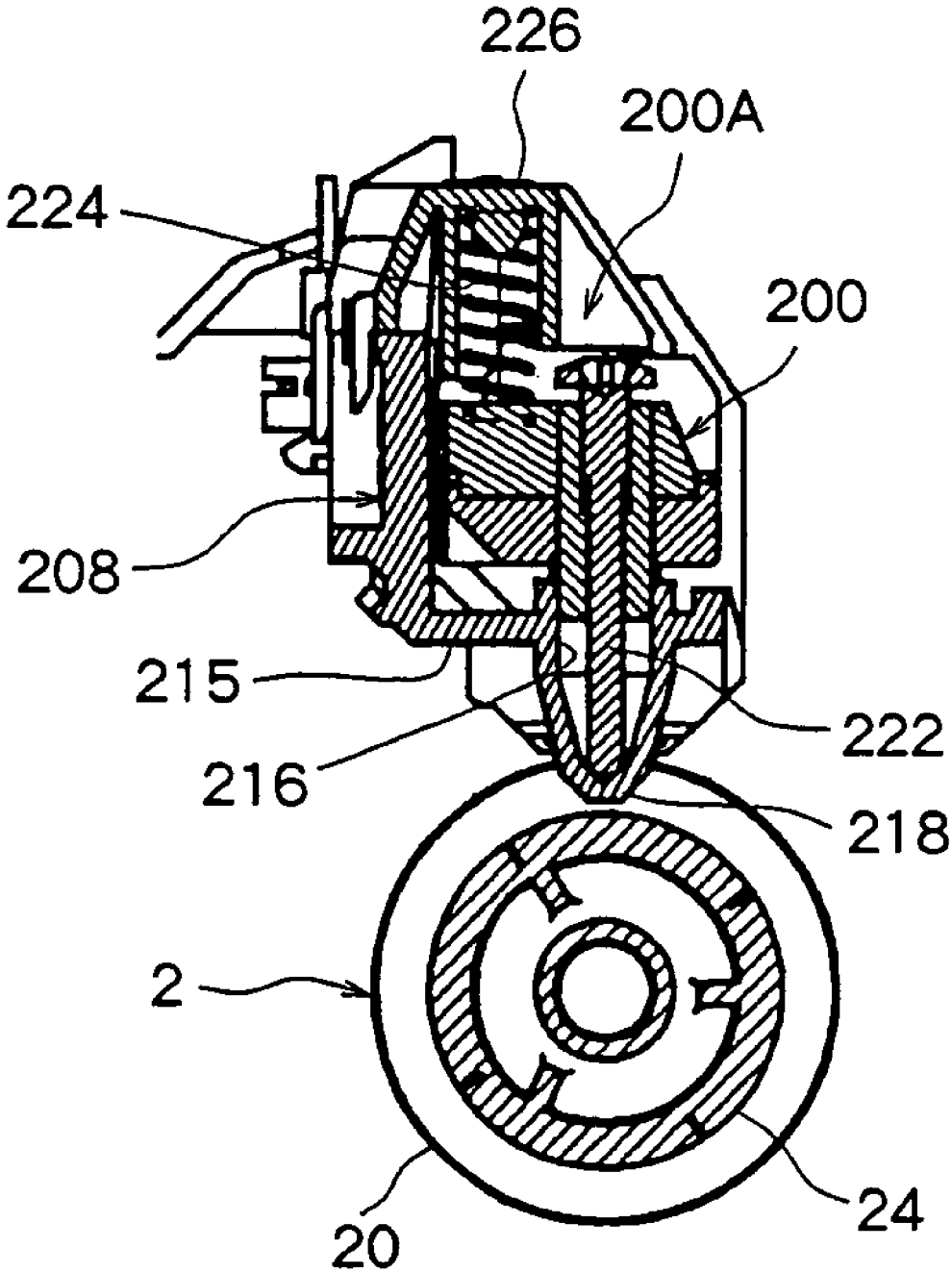
FIG. 7 is a sectional view along the line A-A in FIG. 6.

The drum-holding frame 100 that can be integrally formed by using a suitable synthetic resin has a pair of side walls 12 and 14, and a coupling frame 16 for coupling the side walls 12 and 14 together. Referring to FIG. 6, the photosensitive drum 2 has a cylindrical drum (blank pipe) 20 coated on the surface thereof with a photoconductor substance, annular flange members 22 and 24 forcibly inserted in both end portions of the drum 20, and a shaft 26. The flange members 22 and 24 are supported by the shaft 26 so as to be freely rotated. Both ends of the shaft 26 protrude by a predetermined length from both ends of the flange members 22, 24 and of the drum 20, and are supported by the corresponding side walls 12 and 14 of the drum-holding frame 100. Both ends of the shaft 26 protrude outward beyond the corresponding side walls 12 and 14. Both ends of the shaft 26 protruding outward beyond the side walls 12 and 14 constitute first positioning projections arranged on both side walls 12 and 14 of the drum-holding frame 100 and having an axis common to the axis of the photosensitive drum 2.

Figure 5:
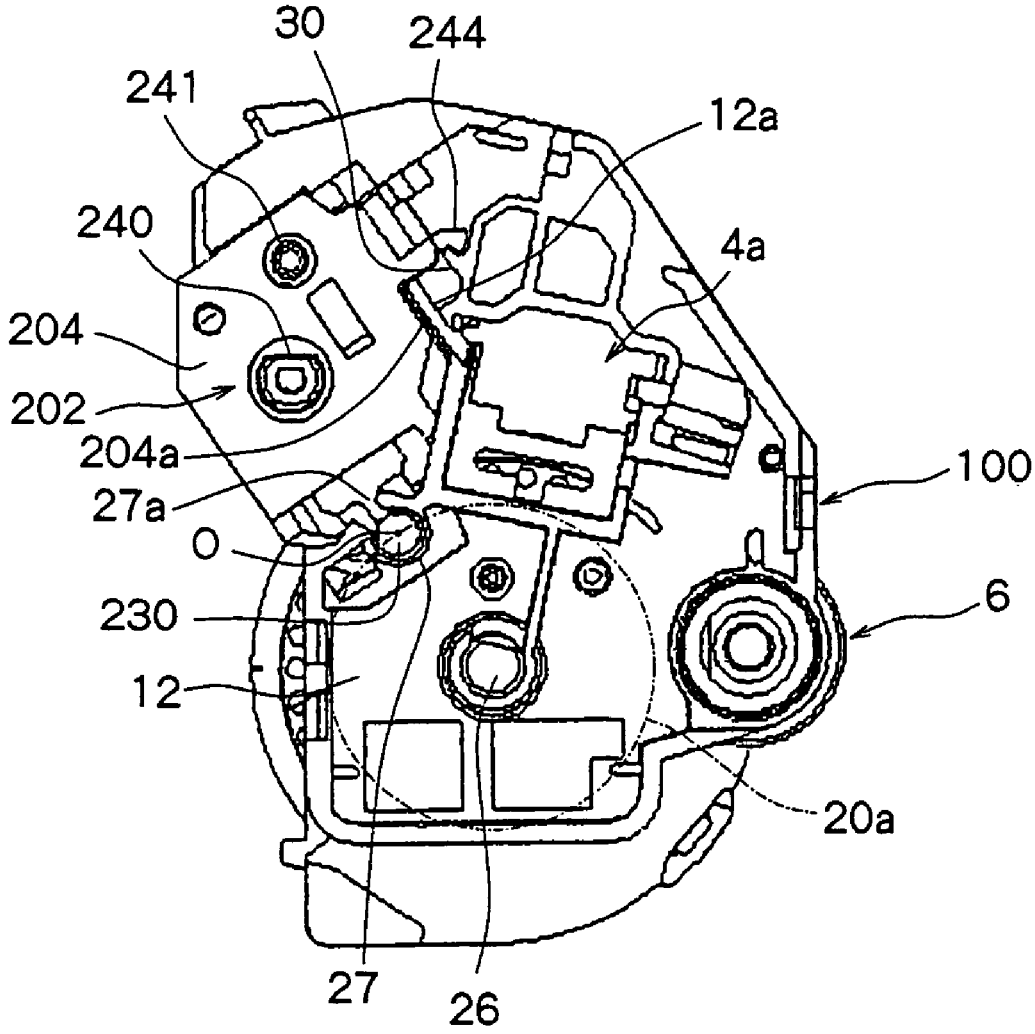
FIG. 5 is a side view of when the photosensitive drum unit shown in FIG. 2 is viewed from one side (right in FIG. 2) in the axial direction of the photosensitive drum in a partly omitted manner.

A driven gear (not shown) is supported by the shaft 26 of the photosensitive drum 2 so as to rotate relative to the shaft 26 of the photosensitive drum 2 neighboring the flange member 24 on the outer side thereof in the axial direction. The driven gear is integrally coupled so will not to rotate relative to the flange member 24. Referring to FIG. 6, annular grooves 26*a* and 26*b* are formed in one end portion of the shaft 26 of the photosensitive drum 2. The annular groove 26*a* is to inhibit the movement in the axial direction when one end of the shaft 26 of the photosensitive drum 2 is fitted to the lower end of a first positioning groove 422 of one side frame 420 that will be described later. The annular groove 26*b* is for being fitted with a stop ring (not shown) to prevent the driven gear (not shown) from escaping. In the drum-holding frame 100, there are arranged the above-mentioned charging unit 4 and the cleaning unit 6. In FIG. 5, a sign 4*a* denotes amounting portion for mounting the charging unit 4.

Fitting holes 27 and 28 are formed at predetermined edge portions of the side walls 12 and 14 of the drum-holding frame 100. In part of the region in the circumferential direction of the fitting hole 27 formed in the side wall 12, there is formed a notch 27*a* (see FIG. 5) having a width shorter than the diameter thereof. One end of the notch 27*a* in the radial direction is opened in the fitting hole 27, and the other end thereof in the radial direction is opened in the edge (upwardly facing edge) of the side wall 12. The axes O of the fitting holes 27 and 28 are on a common axis in parallel with the axis of the photosensitive drum 2, i.e., in parallel with the axis of the shaft 26 of the photosensitive drum 2, and are arranged on a common imaginary axis line on the peripheral surface of the photosensitive drum, on which an image is formed by the LED head 200 that will be described later, i.e., on the peripheral surface of the drum 20. In FIG. 5, a circle indicated by a two-dot chain line is a circumference of the peripheral surface of the drum 20.

The head-holding frame 202 that can be integrally molded from a suitable synthetic resin has a pair of side walls 204 and 206, and a coupling frame 208 integrally coupled to the side walls 204 and 206. The LED head 200 is arranged between the side walls 204 and 206. The LED head 200 that is constituted in a known manner comprises an LED array 210, a rod lens array 212 and a frame 214 for holding them. Both side portions of the LED head 200 in the lengthwise direction are supported by the head-holding frame 202 via a radial direction position-adjusting means 200A which capable of adjusting the position in the radial direction relative to the peripheral surface of the photosensitive drum 2.

The radial direction position adjusting means 200A comprise fitting holes 216 formed in the bottom wall portions 215 disposed integrally in the inside of both side portions of the head-holding frame 202, the fitting holes 216 being such that the ends thereof on the bottom wall side being closed by the closing walls 218 and the other ends thereof being opened; cylindrical portions 220 that are formed integrally on both side portions of the LED head 200 and are internally threaded along the inner peripheral surfaces thereof, the cylindrical portions 220 being inserted in the fitting holes 216 from the other ends thereof to be slidably fitted thereto; radial direction position adjusting bolts 222 that are brought into engagement with the cylindrical portions 220 and into contact at the front ends thereof with the closing walls 218 of the bottom wall portion 215; and resilient means or, in this embodiment, compression coil springs 224, for urging both side portions of the LED head 200 toward the bottom wall portion 215.

The bottom wall portion 215 of the head-holding frame 202 is formed by a part of the coupling frame 208 of the head-holding frame 202. In the intermediate region of the bottom wall portion 215 in the lengthwise direction, there is formed an opening 215a which is slender in the lengthwise direction so as not to prevent the exposure to light emitted from the LED head 200 onto the peripheral surface of the photosensitive drum 2. Between the side walls 204 and 206 of the head-holding frame 202, there is arranged a ceiling wall 226 facing the bottom wall portion 215, and the compression coil springs 224 are arranged between the two side portions of the ceiling wall 226 and the two side portions of the frame 214 of the LED head 200. The axes of the fitting holes 216 extend in parallel to each other and are positioned at right angles with the axis of the photosensitive drum 2 (axis of the shaft 26). The radial direction position adjusting means 200A are constituted as described above. By suitably rotating the bolts 222, therefore, the position of the LED head 200 in the radial direction relative to the peripheral surface of the photosensitive drum 2 can be easily and reliably adjusted. As heads of the bolts 222 are exposed on the upper side, the focus-adjusting operation can be easily conducted.

Figure 4:
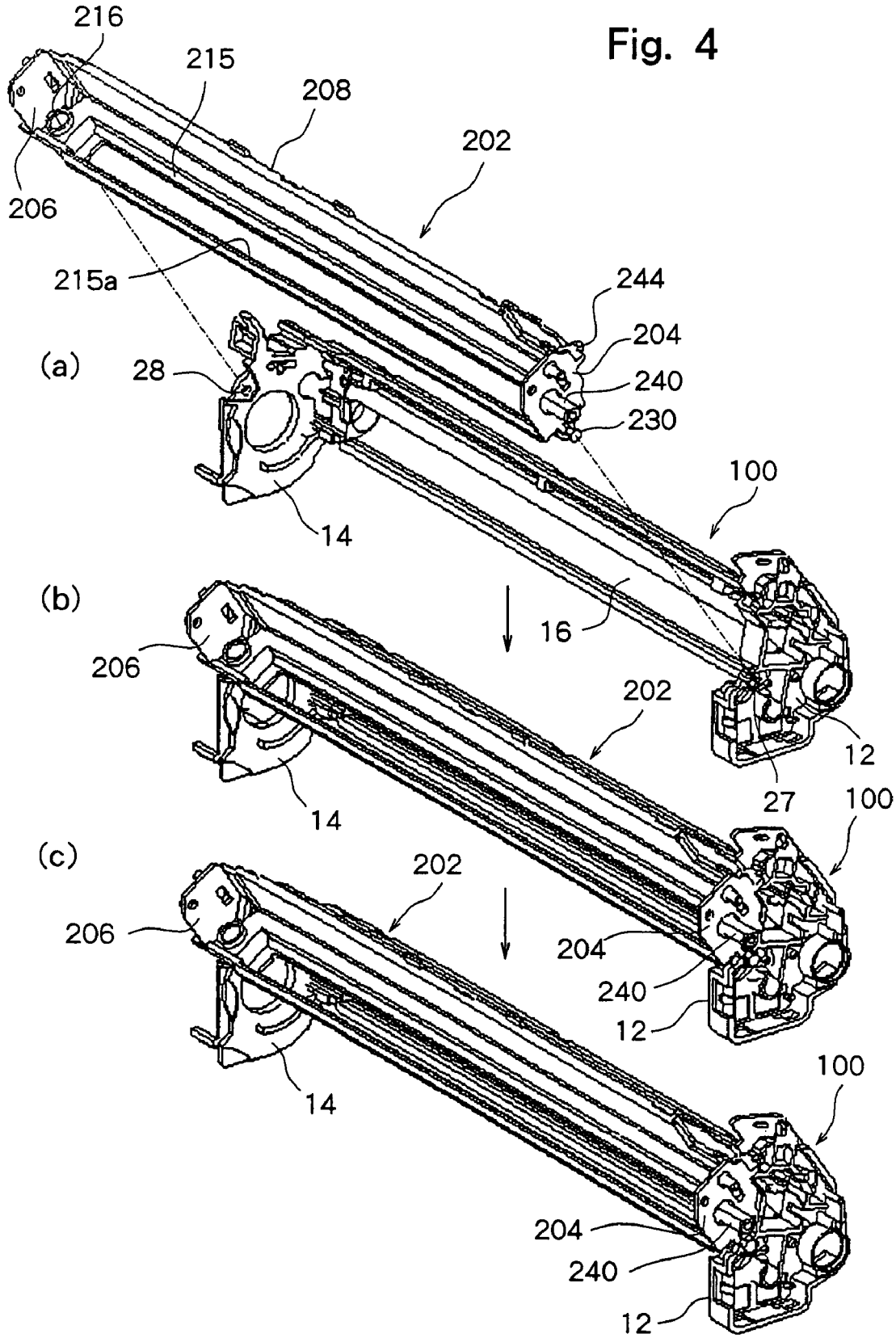
FIG. 4(*a*) is a disassembled perspective view of a head-holding frame and a drum-holding frame provided in the photosensitive drum unit illustrated in FIG. 2, FIG. 4(*b*) is a perspective view illustrating a state just after the above two are assembled together, and FIG. 4(*c*) is a perspective view illustrating a state after relatively moved in the axial direction from the state of FIG. 4(*b*)

Shafts 230 are integrally formed so as to extend outward from the lower end portions of the side walls 204 and 206 defining both sides of the head-holder frame 202. The shaft 230 of one side only is illustrated in FIGS. 4(*a*) and 5. The one shaft 230 formed on one side wall 204 has a small diameter in the proximal region in the axial direction thereof and a large diameter in the distal region in the axial direction thereof. The small-diameter portion of the one shaft 230 has a diameter slightly smaller than the width of the notch 27*a* of the fitting hole 27 formed in the side wall 12 of the drum-holding frame 100 described above, and the large-diameter portion thereof is formed to be slightly smaller than the diameter of the fitting hole 27. The other shaft 230 formed on the other side wall 206 is formed to be slightly smaller than the diameter of the fitting hole 28 formed in the side wall 14 of the drum-holding frame 100. The shafts 230 each exist on a common axis.

A positioning shaft 240 is integrally formed so as to extend outward from the central portion of the side wall 204 of the head-holding frame 202. Further, a positioning/pushing shaft 242 is integrally formed so as to extend outward from the central portion of the side wall 206 of the head-holding frame 202. The positioning shaft 240 and the positioning/pushing shaft 242 are longer than the above shaft 230 and exist on a common axis. The axis of the positioning shaft 230 and the positioning/pushing shaft 242 is in parallel with the axis of each of the shafts 230. The positioning shaft 240 and the positioning/pushing shaft 242 constitute second positioning projections in parallel with the shaft 26 of the photosensitive drum 2 disposed on both side walls 204 and 206 of the head-holding frame 202.

The head-holding frame 202 for holding the LED head 200 as described above is supported so as to move in only the axial direction of the photosensitive drum 2 relative to the drum-holding frame 100. If described in further detail with reference to FIGS. 4 and 5, both side walls 204 and 206 of the head-holding frame 202 are coupled to (supported by) the drum-holding frame 100 so as to move in only the axial direction of the photosensitive drum 2 by fitting each of the shafts 230 disposed on both side walls 204 and 206 of the head-holding frame 202 to the fitting holes 27 and 28 formed in the side walls 12 and 14 of the drum-holding frame 100.

Figure 11:
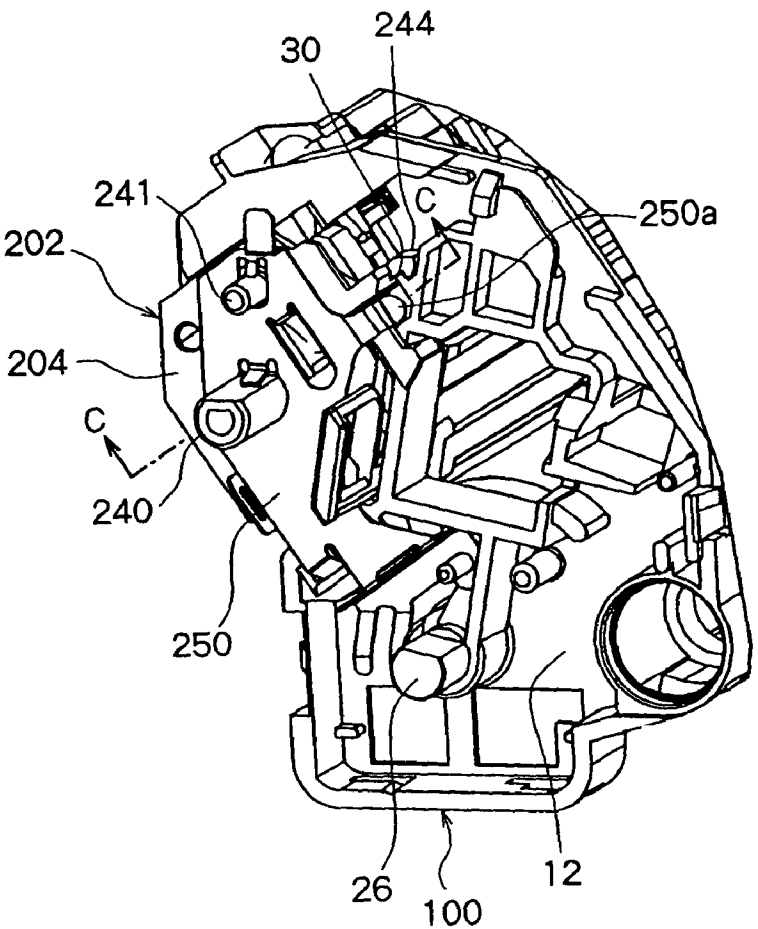
FIG. 11(*a*) is a perspective view of one side surface of the photosensitive drum unit of FIG. 2 in a state where cover members are removed from both side portions thereof.
Figure 11:
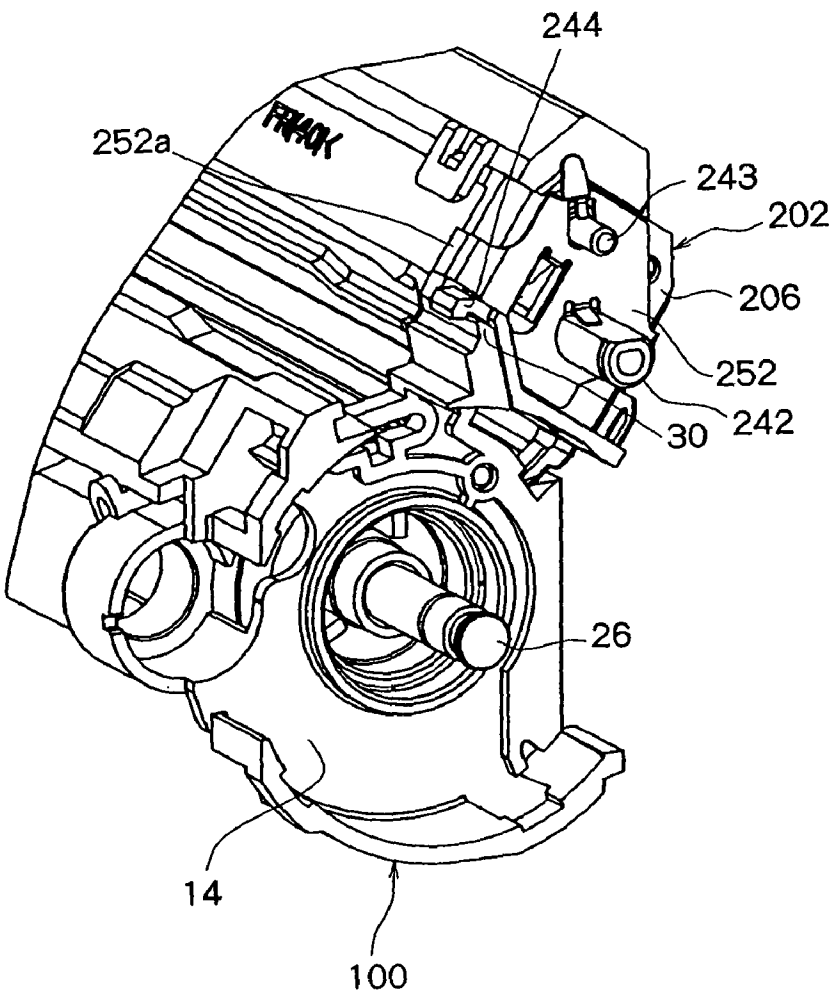
Figure 12:
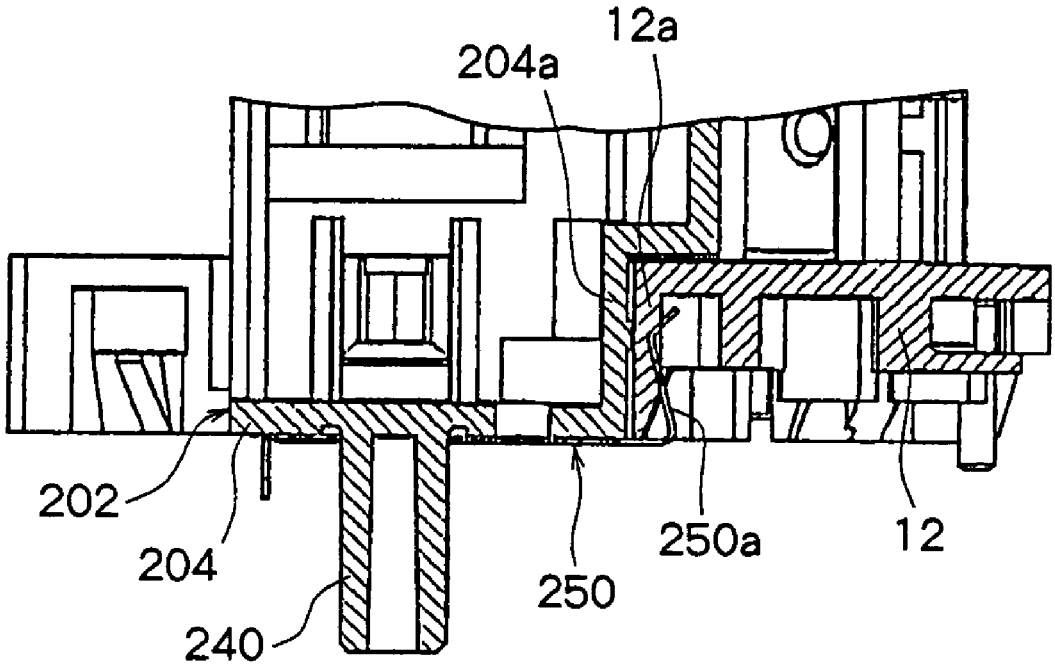
FIG. 12 is a sectional view along the line C-C in FIG. 11(*a*).

The coupling is effected in a manner as described below. Namely, the small-diameter portion of the one shaft 230 (see FIGS. 4(*a*) and 5) of the head holding frame 202 is first fitted into the fitting hole 27 through the notch 27*a* of the fitting hole 27 in the side wall 12 of the drum-holding frame 100. Then, the head-holding frame 202 is moved in one axial direction of the photosensitive drum 2 relative to the drum-holding frame 100 (nearly from the right to the left in FIG. 4, or from the front toward the back of the surface of the paper in FIG. 5) (see FIG. 4(*b*)). Then, the large-diameter portion of one shaft 230 is fitted to the fitting hole 27 and, at the same time, the other shaft 230 is fitted to the fitting hole 28 of the side wall 14 of the drum-holding frame 100 (see FIG. 4(*c*)). As shown in FIGS. 5, 11(*a*) and 11(*b*), hooks 244 are formed on the side edge portions of the side walls 204 and 206 of the head-holding frame 202 so as to extend in the rotational direction nearly around the above-mentioned axis O, and engaging projections 30 are formed on the corresponding side edge portions of the side walls 12 and 14 of the drum-holding frame 100 so as to extend in the axial direction of the photosensitive drum 2. To effect the coupling, the hooks 244 of the head-holding frame 202 may be tentatively engaged with the corresponding engaging projections 30 of the drum-holding frame 100 to facilitate the coupling operation. The hooks 244 each of the head-holding frame 202 are engaged with the corresponding engaging projections 30 of the drum-holding frame 100 in such a manner to be allowed to slide in the axial direction of the photosensitive drum 2 in a state of the head-holding frame 202 being coupled to the drum-holding frame 100. Therefore, this prevents the head-holding frame 202 from turning on the axis O relative to the drum-holding frame 100 in the counterclockwise direction in FIG. 5, while permitting the sliding motion thereof in small amounts in the axial direction of the photosensitive drum 2.

As shown in FIGS. 11(*a*), 11(*b*) and 12, after the head-holding frame 202 is coupled to the drum-holding frame 100 so as to move in the axial direction of the photosensitive drum 2 as described above, holding plate members 250 and 252 are mounted on the side walls 204 and 206 of the head-holding frame 202 so as to be overlapped on the side walls 204 and 206 from the outer sides. Namely, in addition to the positioning shafts 240 and the positioning/pushing shafts 242 protruding from the side walls 204 and 206, there are further formed shafts 241 and 243 so as to protrude from the side walls 204 and 206 in parallel with the shafts 240 and 242. In the holding plate members 250 and 252 made of suitable metal plates, there are formed holes that can fit to the shafts 240, 241, 242 and 243. At the upper edges of the holes, there are formed resilient engaging pieces extending being substantially inclined downward. As the holes in the holding plate members 250 and 252 are respectively fitted to the positioning shafts 240, 242 and to the positioning/pushing shafts 242, 243 of the side walls 204 and 206, the ends of the resilient engaging pieces formed at the upper edges of the holes are brought into resiliently press-contact with the outer peripheral surfaces of the proximal portions of the positioning shafts 240, 241 and of the positioning/pushing shafts 242, 243. Due to the resilient frictional action of the resilient engaging pieces, the holding plate members 250 and 252 are overlap-mounted on the side walls 204 and 206 so as not to escape outward.

Referring to FIGS. 5, 11(*a*), 11(*b*) and 12, walls 204*a* and 206*a* (not shown) are respectively integrally formed on the side walls 204 and 206 of the head-holding frame 202 at positions near the hooks 244 so as to extend inward in the axial direction of the photosensitive drum 2. On the side walls 12 and 14 of the drum-holding frame 100, there are integrally formed walls 12*a* and 14*a* (not shown), which extend inward in the axial direction of the photosensitive drum 2 and overlap with the outer sides of the walls 204*a* and 206*a*. Resilient pushing pieces 250*a* and 252*a* extending inward in the axial direction of the photosensitive drum 2 are integrally formed on the side edges of the holding plate members 250 and 252 made of suitable resilient metal plates at positions close to the hooks 244 of the head-holding frame 202. The resilient pushing pieces 250*a* and 252*a* resiliently push the outer surfaces of the walls 12*a* and 4*a* of the drum-holding frame 100 toward the walls 204*a* and 206*a* of the head-holding frame 202. As a result, the head-holding frame 202 is substantially integrally secured to the drum-holding frame 100 due to the resilient pushing forces of the resilient pushing pieces 250*a* and 252*a* of the holding plate member 250 and 252 but being allowed to move in small amounts in only the axial direction of the photosensitive drum 2 (the head-holding frame 202 is not rigidly coupled to the drum-holding frame 100).

Referring to FIG. 5, in a state where the head-holding frame 202 is coupled to the drum-holding frame 100 so as to move in only the axial direction of the photosensitive drum 2 as described above, the axes O of the shafts 230 disposed on the side walls 204 and 206 of the head-holding frame 202 and the axes C of the fitting holes 27 and 28 in both side walls 12 and 14 of the drum-holding frame 100, are arranged on a common imaginary axis line in parallel with the axis of the photosensitive drum 2 and on a common imaginary axis line on the peripheral surface, on which an image is focused by the LED head 200, of the photosensitive drum 2. Owing to this constitution, even when the head-holding frame 202 is slightly inclined relative to the drum-holding frame 100, the focal point of the LED head 20o held by the head-holding frame 202 is prevented from being deviated from the image-forming surface on the peripheral surface of the photosensitive drum 2.

Figure 8:
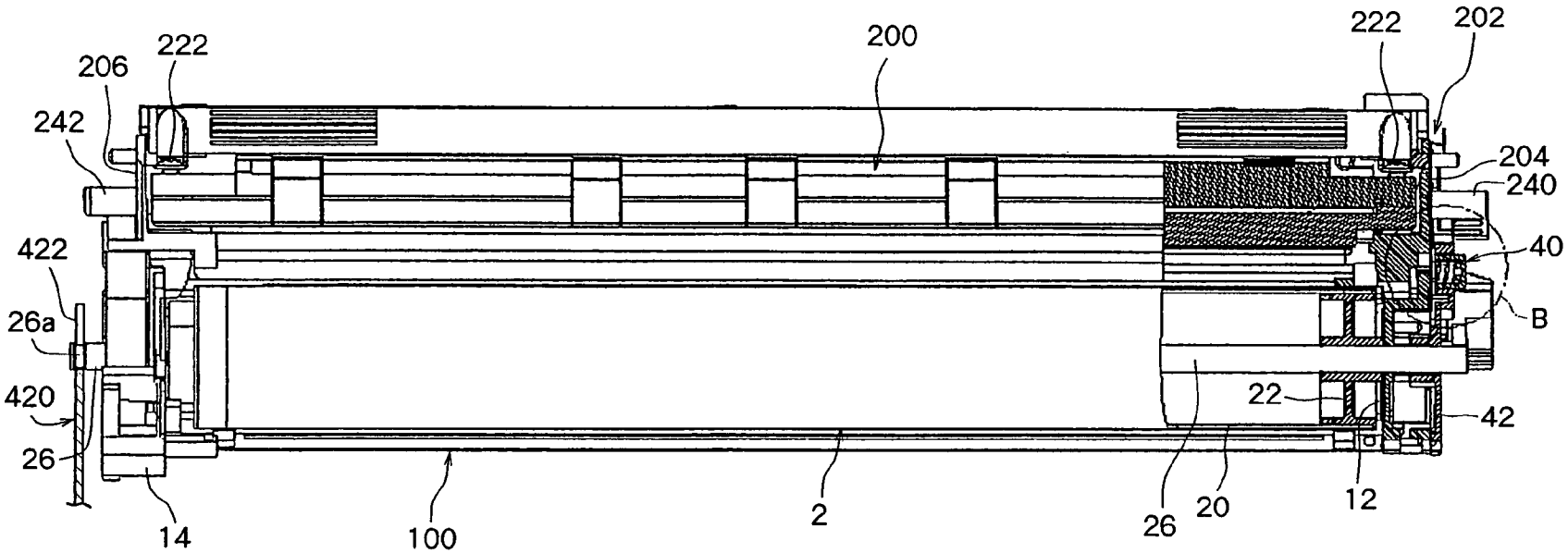
FIG. 8 is a front view of the photosensitive drum unit of FIG. 2 illustrating partly in cross section.
Figure 9:
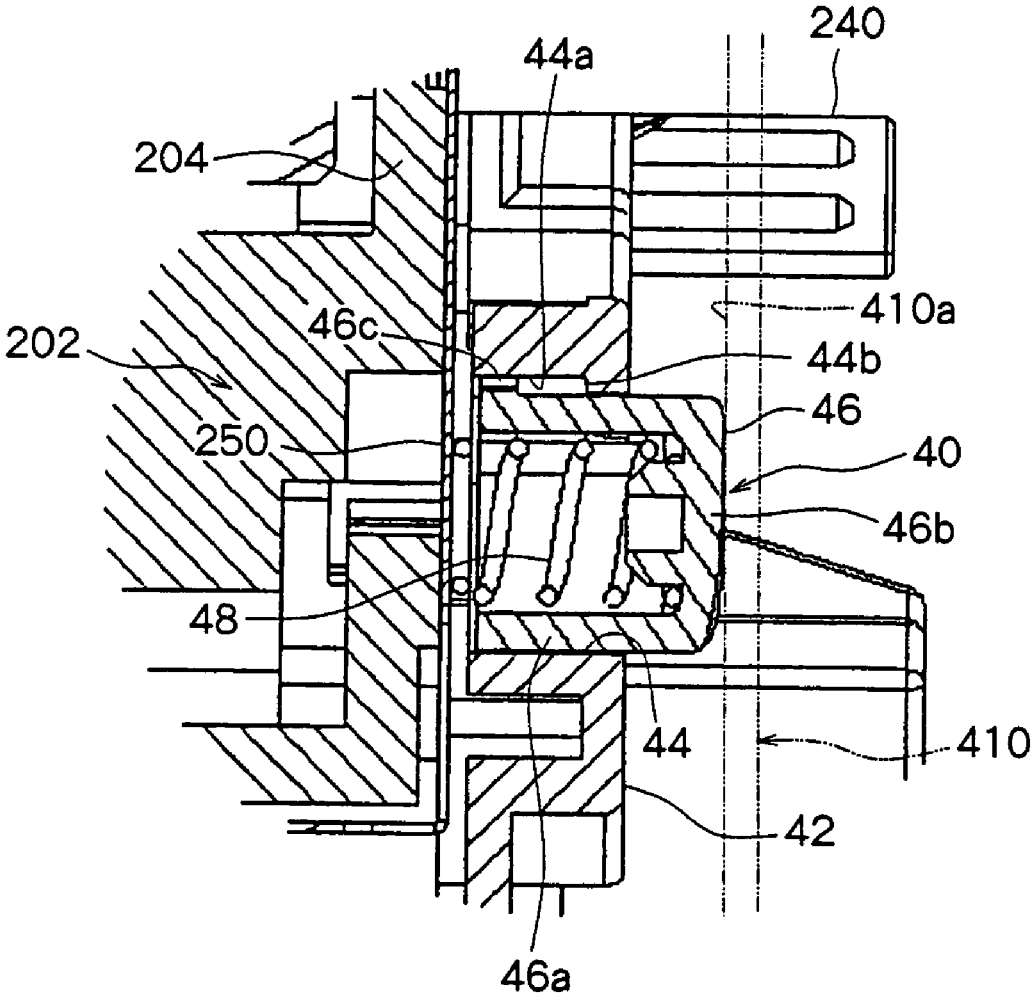
FIG. 9 is a view illustrating a portion B of FIG. 8 on an enlarged scale.
Figure 10:
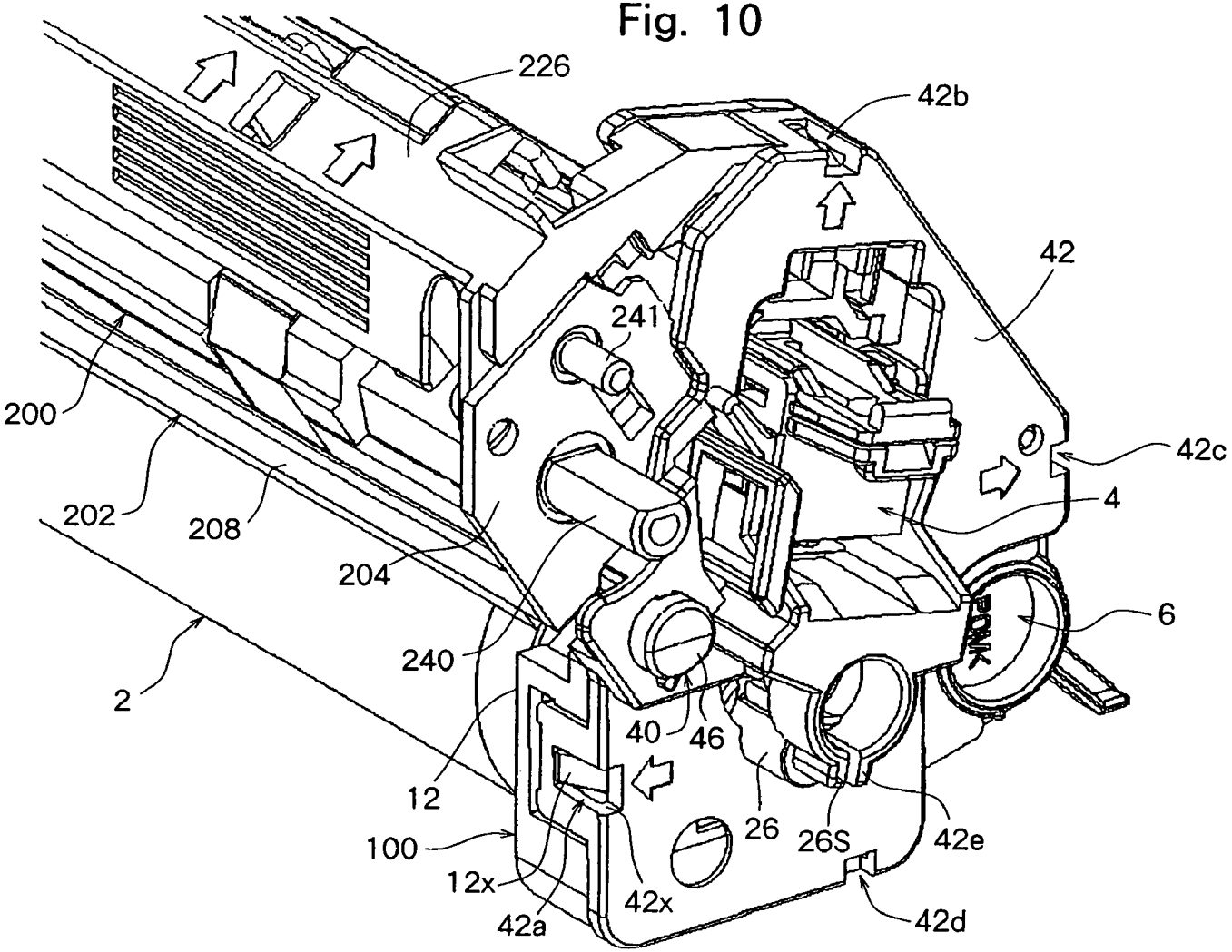
FIG. 10 is a perspective view of a right end portion in FIG. 2, of the photosensitive drum unit of FIG. 2.

Referring to FIGS. 8 to 10, on one side of the drum-holding frame 100, there is disposed a pressing means 40 (more specifically, a resilient pressing means 40) for pressing the head-holding frame 202 onto the drum-holding frame 100 in a direction from one side to the other side of the drum-holding frame 100 (in a direction from the right toward the left in FIG. 8) which is the axial direction of the photosensitive drum 2.

If described in further detail, a cover member 42 that can be integrally molded by using a suitable synthetic resin is mounted on the side wall 12 of the drum-holding frame 100 from the outer side thereof. The cover member 42 is locked with the side wall 12 via suitable locking means 42*a*, 42*b*, 42*c* and 42*d* so as not to escape in the axial direction and so as not to turn relative thereto (see FIG. 10). In the embodiment illustrated in FIG. 10, the locking means 42*a* is constituted by an locking portion 12*x* provided on the side wall 12 side and a to-be-locked hole 42*x* formed in a flange portion extending from the side edge of the cover member 42 in a direction toward the side wall 14, which is the axial direction of the photosensitive drum 2. The locking portion 12*x* that is nearly of a rectangular shape is so inclined that the thickness thereof gradually increases toward the side wall 14. The to-be-locked hole 42*x* that is nearly of a rectangular shape is formed to be slightly larger than the locking portion 12*x*. By-pushing the cover member 42 from the outer side of the side wall 12 toward the side wall 14 that is the axial direction of the photosensitive drum 2, the flange portion of the cover member 42 is resiliently deformed, whereby the pushing movement is stopped at a position where the side edge on the side of the pushing direction, of the to-be-locked hole 42*x* has exceeded the side edge on the side of the pushing direction, of the locking portion 12*x* of the side wall 12. Other locking means 42*b*, 42*c* and 42*d*, too, have substantially the same constitution. By the above pushing operation of the cover member 42, the same locking operations are effected simultaneously. Thus, the cover member 42 is mounted on the side wall 12 of the drum-holding frame 100 in a manner to cover the outer side of the side wall 12.

In an overhung portion of the cover member 42, there is formed a protruding portion 42*e* that extends downward. The protruding portion 42*e* penetrates through the side wall 204 and the cover member 42 and is fitted to a slit 26S formed in one end portion that protrudes outward, of the shaft 26 of the photosensitive drum 2. Thereby, the rotation of the shaft 26 of the photosensitive drum 2 relative to the drum-holding frame 100.is prevented. As will be easily understood from the foregoing description, it can be said that the cover member 42 constitutes part of the one side wall 12 of the drum-holding frame 100. It can therefore be said that the pressing means 40 is arranged on one side wall 12. The region, on which the pressing means 40 is disposed, of the one side wall 12 is located on the outer side of the one side wall 204 of the head-holding frame 200.

The pressing means 40 is disposed on the cover member 42. Namely, in the cover member 42, there is formed a through hole 44 having an axis in parallel with the axis of the photosensitive drum 2. The inner surface of the region where the through hole 44 is formed, of the cover member 42 is positioned to be opposed to part of the region on the outer surface of the holding plate member 250 mounted on the side wall 204 of the head-holding frame 202. In the inner peripheral surface of the through hole 44, there is formed a guide groove 44*a* which, while maintaining a predetermined width in the circumferential direction, linearly extends from one end of the side facing the holding plate member 250 up to a position close to the other end thereof in the axial direction. A step portion 44*b* is formed between the other end (the other end on the side in the axial direction opposite to the side facing the holding plate member 250) of the guide groove 44*a* and the inner peripheral surface of the through hole 44.

A cap-shaped pressing member 46 that comprises a cylindrical portion 46*a* and a closing wall 46*b* and is opened at one end in the axial direction, is fitted into the through hole 44 so as to slide in the axial direction but so as not to rotate. Namely, in an end portion in the outer peripheral surface of the pressing member 46 in the axial direction (i.e., in an end portion of the side facing the holding plate member 250 and on the opening side), there is formed a to-be-guided projection 46*c* that linearly extends in the axial direction toward the other end thereof while maintaining a predetermined width in the circumferential direction. The pressing member 46 is fitted to the through hole 44 in a state where the to-be-guided projection 46*c* is fitted to the guide groove 44*a* in the through hole 44 so as to slide. The open end of the pressing member 46 is so positioned as to be opposed to the holding plate member 250. The length of the pressing member 46 in the axial direction is longer than the length of the through hole 44 in the axial direction. A compression coil spring 48 is disposed in the pressing member 46. One end of the compression coil spring 48 is pressed onto, and contacted with, the closing wall 46*b* of the pressing member 46, and the other end thereof is pressed onto, and contacted with, the outer surface of the holding plate member 250.

In a mounting state where no external force in the axial direction acts on the pressing member 46, the pressing member 46 slides, in the through hole 44, in the axial direction (toward the right in FIG. 9) so as to separate away from the holding plate member 250 by a spring force of the compression coil spring 48. The movement of the pressing member 46 in the axial direction is limited as an end of the to-be-guided projection 46*c* of the pressing member 46 comes in contact with the step portion 44*b* of the guide groove 44*a* in the through hole 44 (it can be said that the pressing member 46 is protruded from one side wall 12 of the drum-holding frame 100, and is so arranged that its movement is limited at a predetermined position in a direction in which it separates away from one side wall 204 of the head-holding frame 202). Part of the region of the pressing member 46 in the axial direction (part of the region on the side of the closing wall 46*b*) is caused to protrude outward from the outer surface of the cover member 42. When the pressing member 46 receives an external force in a direction to approach the holding plate member 250 and the external force is greater than a spring force of the compression coil spring 48, the pressing member 46 is moved in a direction to approach the holding plate member 250 against the spring force of the compression coil spring 48. A pushing force acts on the holding plate member 250 to push the head-holding frame 202 relative to the drum-holding frame 100 in a direction from the one side toward the other side of the head-holding frame 202, which is the axial direction of the photosensitive drum 2 (in a direction from the right toward the left in FIGS. 8 and 9). Therefore, the head-holding frame 202 is moved in the same direction as the drum-holding frame 100. Another cover member that is not shown is mounted on the other side wall 206, too, of the drum-holding frame 100. This cover member, however, is not provided with the pressing means 40.

Figure 2:
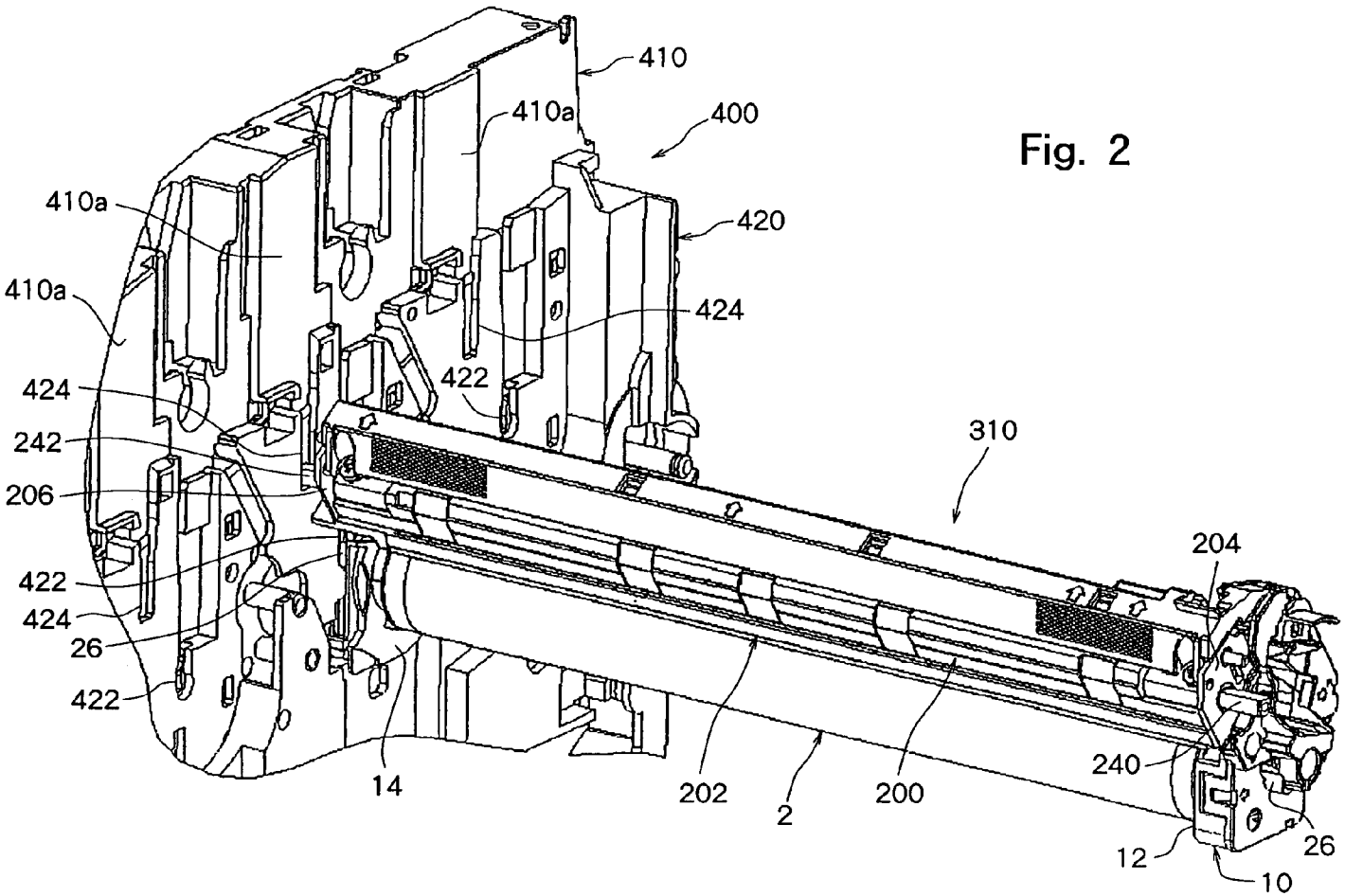
FIG. 2 is a perspective view illustrating, in a partly omitted manner, a state where a photosensitive drum unit provided in the image forming apparatus shown in FIG. 1 is mounted on the other stationary side wall.
Figure 3:
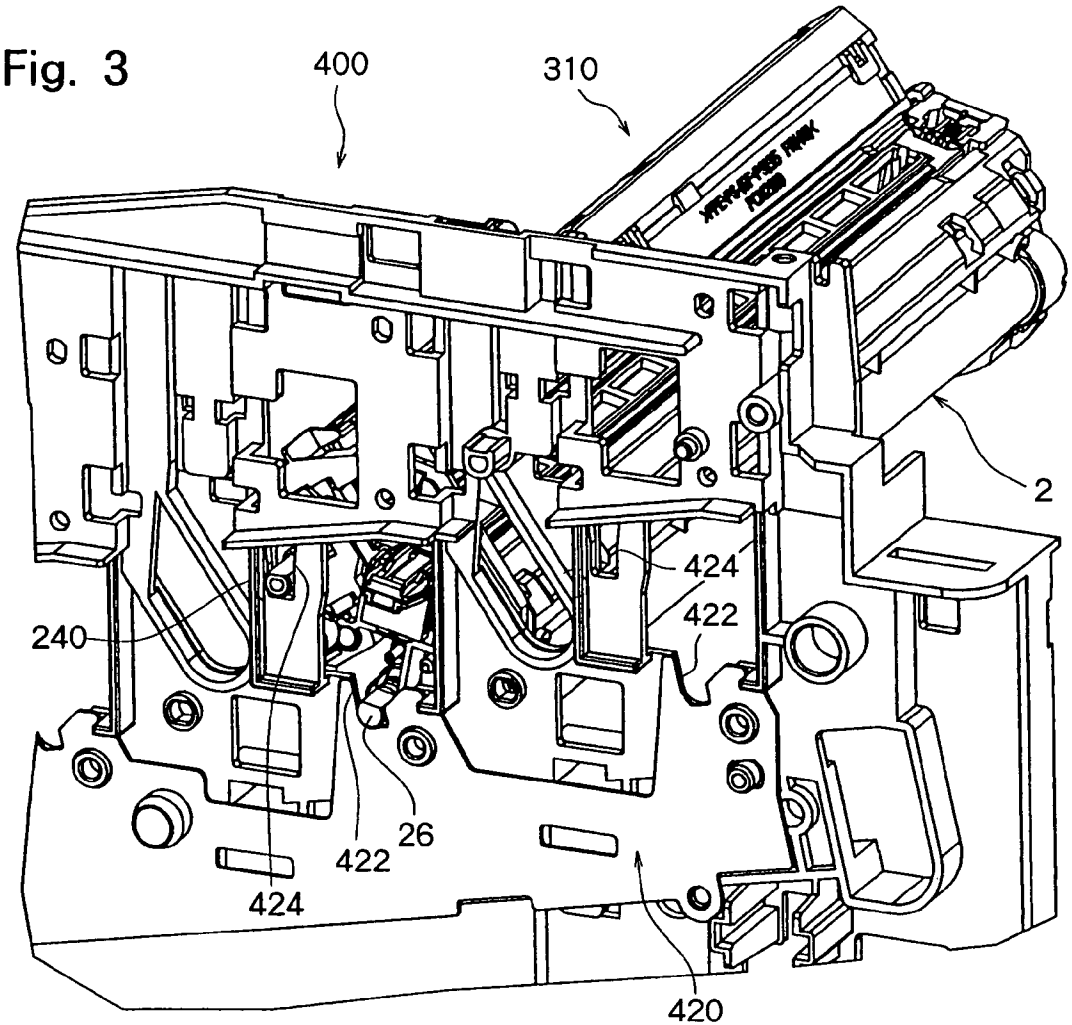
FIG. 3 is a perspective view illustrating, in a partly omitted manner, a state where the photosensitive drum unit provided in the image forming apparatus shown in FIG. 1 is mounted on one stationary side wall.

Referring to FIGS. 2, 3, 8 and 9, the thus constituted photosensitive drum unit 310 is detachably supported between the pair of stationary side walls 400 arranged in the image forming apparatus body 302 of the image forming apparatus 300 illustrated in FIG. 1. The photosensitive drum unit 310 is supported between the stationary side walls 400 after the position of the LED head 200 is adjusted by the respective radial direction position-adjusting means 200A in the radial direction relative to the peripheral surface of the photosensitive drum 2. Each stationary side wall 400 comprises stationary side wall bodies 410, which are mounted in an erect posture and face each other at predetermined positions in the image forming apparatus body 302, and side frames 420 mounted integrally therewith on the inside of each of the stationary side wall bodies 410. FIG. 3 partly illustrates the stationary side wall body 410 and the side frame 420 of one side, and FIG. 2 partly illustrate the stationary side wall body 410 and the side frame 420 of the other side. However, the stationary side wall bodies 410 and the side frames 420 of the one side and those of the other side have substantially the same fundamental structures. If possible, it is desired that each of the stationary side walls 400 is constituted by integrally molding the stationary side wall body 410 and the side frame 420 from an appropriate synthetic resin.

The stationary side wall bodies 410 and the side frames 420 can be each integrally molded together by using a synthetic resin. Each side frame 420 has a first positioning groove 422 and a second positioning groove 424, which extend in substantially a vertical direction. The first positioning grooves 422 are each for holding, at predetermined positions, both ends that are the first positioning projections, of the shaft 26 of the photosensitive drum 2. The second positioning grooves 424 are each for holding, at predetermined positions, the positioning shafts 240 and the positioning/pushing shafts 242, which are the second positioning projections to be inserted, formed on the side walls 204 and 206 of the head-holding frame 202. The positioning shaft 240 is inserted in the second positioning groove 424 of one side frame 420 shown in FIG. 3, and the positioning/pushing shaft 242 is inserted in the second positioning groove 424 of the other side frame 420 shown in FIG. 2.

The first positioning grooves 422 and the second positioning grooves 424 have each upper ends that are opened upward and lower ends that are closed. In the illustrated embodiment, the first positioning grooves 422 have a relatively short length between the upper ends and the lower ends in the vertical direction, and the closed lower ends have a curved surface expanding downward. The first positioning grooves 422 of one side frame 420 shown in FIG. 3 have a width slightly greater than the diameter of the shaft 26 that is inserted, of the photosensitive drum 2. The first positioning grooves 422 of the other side frame 420 shown in FIG. 2 have a width slightly greater than the diameter of the annular groove 26*a* (see FIG. 6) formed in one end of the shaft 26 that is inserted, of the photosensitive drum 2. The second positioning grooves 424 have a relatively long length between the upper ends and the lower ends in the vertical direction, extend from the upper ends down to the lower ends in the vertical direction at a predetermined width, and the closed ends have flat surfaces. The second positioning grooves 424 in one side frame shown in FIG. 3 have a width slightly greater than the diameter of the positioning shaft 240 that is inserted. The second positioning grooves 424 of the other side frame 420 shown in FIG. 2 have a width slightly greater than the diameter of the positioning/pushing shaft 242 that is inserted.

As viewed in a direction in which the side frames 420 are facing each other (axial direction of the photosensitive drum 2 in a state where the photosensitive drum unit 310 is mounted), the axes at the lower ends of the first positioning grooves 422 are arranged substantially in alignment with the axis of the photosensitive drum 2, and the axes at the lower ends of the second positioning grooves 424 are each arranged substantially in alignment with the axes of the positioning shaft 240 and of the positioning/pushing shaft 242. As will be easily understood from FIG. 5, as viewed in the axial direction, the axes of the positioning shaft 240 and of the positioning/pushing shaft 242 are positioned obliquely upward from the axis of the photosensitive drum 2 and located at an obliquely upward position on the upstream side in a direction (direction of from the left to the right in FIG. 5) in which the recording papers are conveyed. The axis O is located nearly at the center of the above axes.

In the illustrated embodiment, the closed lower ends of the first positioning grooves 422 have curved surfaces expanding downward, and the closed lower ends of the second positioning grooves 424 are forming flat surfaces. The shapes of the closed lower ends, however, are in no way limited. The closed lower end of the first positioning groove 422 in one side frame 420 illustrated in FIG. 3 may have any shape as far as it is capable of receiving and supporting the shaft 26 of the photosensitive drum 2. The closed lower end of the first positioning groove 422 in the other side frame 420 illustrated in FIG. 2 may have any shape as far as it is capable of receiving, anchoring and supporting the annular groove 26*a* formed in one end of the shaft 26 of the photosensitive drum 2. Further, the closed lower end of the second positioning groove 424 in one side frame 420 illustrated in FIG. 3 may have any shape as far as it is capable of receiving and supporting the positioning shaft 240. The closed lower end of the second positioning groove 424 in the other side frame 420 illustrated in FIG. 2 may have any shape as far as it is capable of receiving and supporting the positioning/pushing shaft 242. Specific shapes of the closed lower ends of the first and second positioning grooves 422 and 424 may be, for example, such a shape as arcuate surface, semicircular surface, horizontal surface, V-shaped surface or curved surface, etc.

On the outer sides of the regions where the second positioning grooves 424 are formed in the stationary side walls 400, positioning wall surfaces 410*a* are formed substantially integrally with the stationary side walls 400 so as to be positioned at a predetermined distance relative to the above regions on the outer sides of the regions where the respective second positioning grooves 424 are formed in the side frames 420 in the illustrated embodiment, the positioning wall surfaces 410*a* are formed in the stationary side wall bodies 410 so as to be located at a predetermined gap relative to the above regions of the side frames 420. The positioning wall surfaces 410*a* are substantially vertical surfaces. The function of the positioning wall surfaces 410*a* will be described later.

The above-mentioned photosensitive drum unit 310 is detachably supported at predetermined positions between the respective stationary side walls 400 after focus adjustment, in other words, after the LED head 200 is adjusted for its position in the radial direction relative to the peripheral surface of the photosensitive drum 2 by using the above-mentioned radial direction position-adjusting means 200A disposed on both sides of the LED head 200. In a state where the photosensitive drum unit 310 is supported at predetermined positions between the respective stationary side walls 400, the drum-holding frame 202 is supported by the respective stationary side walls 400 so as not to move in the axial direction of the photosensitive drum 2, and the pressing means 40 is pushed upon coming in contact with the one stationary side wall 400 illustrated in FIG. 3, whereby a portion on the other side of the head-holding frame 202 is pressed onto, and brought into contact with, the other stationary side wall 400, and consequently, the head-holding frame 202 is brought to a predetermined position in the axial direction with the other stationary side wall 400 as a reference.

If described more specifically, the photosensitive drum unit 310 is lowered in a state where the positioning shaft 240 formed on the side wall 204 of the head-holding frame 202 that is the second positioning projection of the photosensitive drum unit 310, is inserted in the second positioning groove 424 in one side frame 420 illustrated in FIG. 3 and at the same time, the positioning/pushing shaft 242 formed on the side wall 206 of the head-holding frame 202 is inserted in the second positioning groove 424 in the other side frame 420 illustrated in FIG. 2. In the step of the lowering operation for mounting the photosensitive drum unit 310 on the stationary side walls 400, the other end (right end in FIG. 8) of the shaft 26 of the photosensitive drum 2, which is the first positioning projection of the photosensitive drum unit 310, is inserted in the first positioning groove 422 in one side frame 420 illustrated in FIG. 3 and, at the same time, one end of the shaft 26 (left end in FIG. 8) is inserted in the first positioning groove 422 in the other side frame 420 illustrated in FIG. 2.

When the photosensitive drum unit 310 is further lowered to a small extent, the positioning shaft 240 formed on the side wall 204 of the head-holding frame 202 is placed on, and supported by, the lower end of the second positioning groove 424 in the one side frame 420 illustrated in FIG. 3, and the positioning/pushing shaft 242 formed on the side wall 206 of the head-holding frame 202 is placed on, and supported by, the lower end of the second positioning groove 424 in the other side frame 420 illustrated in FIG. 2. At the same time, the other end (right end in FIG. 8) of the shaft 26 of the photosensitive drum 2 is placed on, and supported by, the lower end of the first positioning groove 422 in one side frame 420 illustrated in FIG. 3, and one end of the shaft 26 (left end in FIG. 8) is engaged at its annular groove 26*a* with the lower end of the first positioning groove 422 in the other side frame 420 illustrated in FIG. 2, and is supported in a state where the movement in the axial direction is substantially limited. Thereby, the head-holding frame 202 is supported at predetermined positions between the side frames 420 in such a manner that it is substantially limited from moving in the axial direction of the photosensitive drum 2. Owing to the above-mentioned operations, the photosensitive drum unit 310 is mounted at predetermined positions between the respective side frames 420.

During the above-mentioned lowering operation for mounting the photosensitive drum unit 310 on the stationary side walls 400 and after the photosensitive drum unit 310 whose lowering operation has been stopped, has been supported at predetermined positions on the stationary side walls 400, the closing wall 46*b* of the pressing member 46 protruding outward beyond the outer side surface of the cover member 42 by a predetermined length in the axial direction, comes into contact with the positioning wall surface 410*a* of the one stationary side wall body 410 and is pushed relatively thereto (see FIG. 9). The pressing member 46 is moved in the through hole 44 in the cover member 42 in a direction to approach the holding plate member 250 against the spring force of the compression coil spring 48. Since a pressing force for pressing the head-holding frame 202 to the drum-holding frame 100 in the axial direction of the photosensitive drum 2 from one side toward the other side of the head-holding frame 202 (from the right toward the left in FIGS. 8 and 9) acts onto the holding plate member 250, the head-holding frame 202 moves in the same direction together with the drum-holding frame 100.

As a result, the position of the drum-holding frame 100 in the axial direction is determined as the annular groove 26*a* in the shaft 26 of the photosensitive drum 2 is fitted to, and engaged with, the positioning groove 422 in the other side frame 420 illustrated in FIG. 2. In a state where the photosensitive drum unit 310 is supported at predetermined positions of the stationary side walls 400, further, the end of the positioning/pushing shaft 242 of the head-holding frame 202 is pushed onto the positioning wall surface 410*a* of the other stationary side wall body 410 illustrated in FIG. 2. The head-holding frame 202 is held at a predetermined position in the axial direction from the other stationary side wall 400 illustrated in FIG. 2 as a reference or, in this embodiment, from the other stationary side wall body 410 as a reference. As described above, the drum-holding frame 100 and the head-holding frame 202 are pressed and secured by the resilient pushing forces of the resilient pushing pieces 250*a* and 252*a* of the holding plate members 250 and 252. Here, however, the drum-holding frame 100 and the head-holding frame 202 are permitted to move relative to each other in small amounts in the axial direction, and can, hence, be positioned independently from each other.

The image forming apparatus body 302 illustrated in FIG. 1 comprises four photosensitive drum units 310. Therefore, the head-holding frames 202 for the respective photosensitive drum units 310 are aligned at predetermined positions in the axial direction on the basis of the other stationary side wall 400 illustrated in FIG. 2 as a reference or, in the embodiment, on the basis of the other stationary side wall body 410 as a reference. With the head-holding frames 202 of the photosensitive drum units 310 being aligned at predetermine positions in the axial direction with the other stationary side wall body 410 as a reference, the LED heads 200 mounted on the respective head-holding frames 202 are aligned at predetermined positions in the axial direction with the other stationary side wall body 410 (or, more specifically, positioning wall 410*a* of the other stationary side wall body 410) as a reference. As a result, the LED heads 200 are mounted with an increased precision in the axial direction of the photosensitive drums 2 between the respective photosensitive drum units 310 without causing color deviation on the color image, whereby good image is guaranteed. The above action and effect are achieved by the arrangement of a pressing means 40 capable of pressing the head-holding frames 202 from one side toward the other side in the axial direction of the photosensitive drum 2. In a broader sense, the above action and effect are achieved by supporting the head-holding frames 202 so as to move in the axial direction of the photosensitive drum 2 relative to the drum-holding frames 100.

The head-holding frames 202 are supported by the drum-holding frames 100, and the LED heads 200 are supported, at both sides thereof, by the head-holding frames 202 via a radial direction position-adjusting means 200A that are capable of adjusting the positions thereof in the radial direction relative to the peripheral surfaces of the photosensitive drums 2. Therefore, the positions in the radial direction relative to the peripheral surfaces of the photosensitive drums 2, of the LED heads 200 can be easily and correctly adjusted.

Accordingly, the present invention makes it possible to improve the precision in the mounting positions of the LED heads 200 in the axial direction of the photosensitive drums 2. It is further made possible to improve the precision in the mounting positions of the LED heads 200 in the radial direction relative to the peripheral surfaces of the photosensitive drums 2. It is further allowed to improve the precision in the mounting positions of the LED heads 200 in the radial direction relative to the peripheral surfaces of the photosensitive drums 2 as well as to improve the precision in the mounting positions of the LED heads 200 in the axial direction of the photosensitive drums 2.

As will be easily understood from the foregoing description, the photosensitive drum units 310 can be reliably mounted on the side frames 420, i.e., on the predetermined positions of the stationary side walls 400 by simply lowering the photosensitive drums 310 at predetermined positions and hence, it offers easy operability for assembling.

In the above-mentioned embodiment of the invention, the head-holding frame 202 has a constitution to couple it to the drum-holding frame 100 so as to move only in the axial direction of the photosensitive drum 2 by fitting the shafts 230 disposed on both side walls 204 and 206 of the head-holding frame 202 to the fitting holes 27 and 28 formed in both side walls 12 and 14 of the drum-holding frame 100. However, it is also allowable to employ another embodiment for coupling by, conversely, forming the fitting holes 27 and 28 in both side walls 204 and 206 of the head-holding frame 202, and forming the shafts 230 on both side walls 12 and 14 of the drum-holding frame 100 to couple them together. In the above-mentioned embodiment of the invention, further, the first positioning projections disposed on the side walls 12 and 14 of the drum-holding frame 100 are constituted by the shaft 26 of the photosensitive drum 2. However, the first positioning projections may be formed integrally with other members such as the side walls 12 and 14 as far as they have an axis in common with the axis of the photosensitive drum 2. Further, though the above embodiment of the invention has dealt with a tandem-type color image forming apparatus 300 including four photosensitive drum units 310, the photosensitive drum units 310 maybe included in a plural number. In the above embodiment, further, the image forming apparatus 300 is so constituted as to directly transfer a toner image onto a recording paper conveyed by the conveyer belt mechanism 330 through the transfer device 334. However, the image forming apparatus may be of a form in which the toner image is transferred onto an intermediate transfer belt that is a to-be-transferred member and, then, the toner image is transferred onto a recording paper conveyed by the other conveyer mechanism.

What I claim is:

1. An image forming apparatus comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means, the exposure means-holding frame being supported on the drum-holding frame so as to move in an axial direction of the photosensitive drum, relative to the drum-holding frame, and a pressing means for pressing the exposure means-holding frame from one side toward the other side in the axial direction of the photosensitive drum, wherein the pressing means comes pushed in contact with one stationary side wall, and is pushed to press-contact part of the other side of the exposure means-holding frame to the other stationary side wall, causing both sides of the exposure means-holding frame to be aligned with each other at a predetermined position in an axial direction, with the other stationary side wall as a reference.

2. An image forming apparatus according to claim 1, wherein the pressing means is disposed on one side of the drum-holding frame so as to press the exposure means-holding frame from one side toward the other side in the axial direction of the photosensitive drum.

3. An image forming apparatus according to claim 1, wherein the exposure means comprises an LED head.

4. An image forming apparatus comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means, the exposure means-holding frame being supported on the drum-holding frame so as to move in an axial direction of the photosensitive drum, relative to the drum-holding frame, wherein the exposure means-holding frame being supported so as to move in the axial direction relative to the drum-holding frame by fitting shafts or fitting holes being disposed on both side walls that define both sides of the exposure means-holding frame to the fitting holes or the shafts disposed on both side walls of the drum-holding frame, and axes of the shafts or the fitting holes disposed on both side walls of the exposure means-holding frame and the axes of the fitting holes or the shafts disposed on both side walls of the drum-holding frame being arranged on a common imaginary axis line in parallel with the axis of the photosensitive drum, which is on a common imaginary axis line on the peripheral surface where an image is focused by the exposure means, of the photosensitive drum, and a pressing means for pressing the exposure means-holding frame from one side toward the other side in the axial direction of the photosensitive drum.

5. An image forming apparatus comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means, the exposure means-holding frame being supported on the drum-holding frame so as to move in an axial direction of the photosensitive drum, relative to the drum-holding frame, a pressing means for pressing the exposure means-holding frame from one side toward the other side in the axial direction of the photosensitive drum, first positioning projections, having axes common to the axis of the photosensitive drum, disposed on both side walls of the drum-holding frame, second positioning projections in parallel with the axis of the photosensitive drum, disposed on both side walls of the exposure means-holding frame, and a first positioning groove and a second positioning groove for positioning the first positioning projection and the second positioning projection that are inserted therein formed in the stationary side walls.

6. An image forming apparatus comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means, the exposure means-holding frame being supported on the drum-holding frame so as to move in an axial direction of the photosensitive drum, relative to the drum-holding frame, a pressing means for pressing the exposure means-holding frame from one side toward the other side in the axial direction of the photosensitive drum, first positioning projections, having axes common to the axis of the photosensitive drum, disposed on both side walls of the drum-holding frame the first positioning projections being constituted by the shaft of the photosensitive drum, second positioning projections, in parallel with the axis of the photosensitive drum, disposed on both side walls of the exposure means-holding frame, and a first positioning groove and a second positioning groove for positioning the first positioning projection and the second positioning projection inserted therein, formed in the stationary side walls.

7. An image forming apparatus comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means, the exposure means-holding frame being supported on the drum-holding frame so as to move in an axial direction of the photosensitive drum, relative to the drum-holding frame, a pressing means for pressing the exposure means-holding frame from one side toward the other side in the axial direction of the photosensitive drum, first positioning projections, having axes common to the axis of the photosensitive drum, disposed on both side walls of the drum-holding frame, second positioning projections, in parallel with the axis of the photosensitive drum disposed on both side walls of the exposure means-holding frame, wherein the second positioning projection disposed on the other side wall of the exposure means-holding frame is constituted by a positioning/pushing shaft, positioning surface walls are formed substantially integrally with the stationary side walls on the outer sides of the regions of the stationary side walls where the second positioning grooves are formed, and as the first positioning projections are inserted in first positioning grooves and as the second positioning projections are inserted in second positioning grooves thereby enabling the photosensitive drum units to be supported at predetermined positions between the stationary side walls, the pressing means is pushed upon coming in contact with the positioning wall surface of the one stationary side wall, and the front end surface of the positioning/pushing shaft of the exposure means-holding frame is pushed onto the positioning wall surface of the other stationary side wall due to the pressing means, and the first positioning groove and the second positioning groove for positioning the first positioning projections and the second positioning projections inserted therein are formed in the stationary side walls.

8. An image forming apparatus comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means, the exposure means-holding frame being supported on the drum-holding frame so as to move in an axial direction of the photosensitive drum, relative to the drum-holding frame, wherein the exposure means-holding frame has one side wall for defining one side of the exposure means-holding frame, and the drum-holding frame has a side wall for defining one side of the drum-holding frame, which is positioned on the outer side of one side wall of the exposure means-holding frame, and a pressing means for pressing the exposure means-holding frame from one side toward the other side in the axial direction of the photosensitive drum, wherein the pressing means comprises a pressing member comprising a cylindrical portion and a closing wall disposed on one side wall of the drum-holding frame so as to move in the axial direction and a compression coil spring disposed between the pressing member and the one side wall of the exposure means-holding frame, the pressing member is so disposed as to protrude beyond one side wall of the drum-holding frame and is limited at a predetermined position from moving in a direction to separate away from one side wall of the exposure means-holding frame, and, in a state where the photosensitive drum units are supported at predetermined positions between the stationary side walls, the pressing member is pushed in contact with one stationary side wall and, upon press-contacting part of the other side of the exposure means-holding frame with the other stationary side wall, causing the exposure means-holding frame to be aligned with each other, at a predetermined position in an axial direction, with the other stationary side wall as a reference.

9. An image forming apparatus, comprising:

a pair of stationary side walls arranged in an image forming apparatus body; and a plurality of photosensitive drum units supported between the stationary side walls, wherein each of the photosensitive drum units comprises:

a drum-holding frame for holding a photosensitive drum, an exposure means-holding frame for holding an exposure means so as to adjust the position thereof in the radial direction relative to the peripheral surface of the photosensitive drum, the exposure means-holding frame being supported on the drum-holding frame so as to move in an axial direction of the photosensitive drum, relative to the drum-holding frame, and pressing means for pressing the exposure means-holding frame from one side toward the other side in the axial direction of the photosensitive drum, wherein both side portions of the exposure means are supported by the exposure means-holding frame via a radial direction position adjusting means capable of adjusting the positions thereof in the radial direction relative to the peripheral surface of the photosensitive drum, and wherein each of the radial direction position adjusting means includes fitting holes formed in the bottom wall portions disposed integrally in the inside of both side portions of the exposure means-holding frame, the fitting holes being such that the ends thereof on the bottom wall side are closed by the closing walls and the other ends thereof are opened, cylindrical portions formed integrally on both side portions of the exposure means and being internally threaded along the inner peripheral surfaces thereof, the cylindrical portions being inserted in the fitting holes from the other ends thereof so as to slide, radial direction position adjusting bolts brought into engagement with the cylindrical portions and into contact at the front ends thereof with the closing walls in the bottom wall portions, and a spring means for urging both side portions of the exposure means toward the bottom wall portions, wherein the fitting holes are so positioned that the axes thereof extend in parallel with each other and at right angles with the axis of the photosensitive drum.

10. A photosensitive drum unit supported between a pair of stationary side walls in an image forming apparatus body, said drum unit comprising:

a drum-holding frame for holding a photosensitive drum, an exposure means-holding frame for holding an exposure means, the exposure means-holding frame being supported on the drum-holding frame so as to move in the axial direction of the photosensitive drum relative to the drum-holding frame, and a pressing means capable of pressing the exposure means-holding frame from one side toward the other side in the axial direction of the photosensitive drum, wherein the exposure means-holding frame has one side wall for defining one side of the exposure means-holding frame, the drum-holding frame has a side wall for defining one side of the drum-holding frame, which is positioned on the outer side of one side wall of the exposure means-holding frame, the pressing means comprises a pressing member comprising a cylindrical portion and a closing wall disposed on one side wall of the drum-holding frame so as to move in the axial direction and a compression coil spring disposed between the pressing member and the one side wall of the exposure means-holding frame, and the pressing member is so disposed as to protrude beyond one side wall of the drum-holding frame and is limited at a predetermined position from moving in a direction to separate away from one side wall of the exposure means-holding frame.

11. A photosensitive drum unit according to claim 10, wherein the pressing means is disposed on one-side of the drum-holding frame so as to press the exposure means-holding frame from one side toward the other side in the axial direction of the photosensitive drum.

12. A photosensitive drum unit according to claim 10, wherein the exposure means comprises an LED head.

13. A photosensitive drum unit supported between a pair of stationary side walls in an image forming apparatus body, said drum unit comprising:

a drum-holding frame for holding a photosensitive drum, an exposure means-holding frame for holding an exposure means, the exposure means-holding frame being supported on the drum-holding frame so as to move in the axial direction of the photosensitive drum relative to the drum-holding frame, and a pressing means capable of pressing the exposure means-holding frame from one side toward the other side in the axial direction of the photosensitive drum, wherein the exposure means-holding frame is supported so as to move in the axial direction relative to the drum-holding frame by fitting shafts or fitting holes disposed on both side walls that define both sides of the exposure means-holding frame to the fitting holes or the shafts disposed on both side walls of the drum-holding frame, and wherein axes of the shafts or the fitting holes disposed on both side walls of the exposure means-holding frame and the axes of the fitting holes or the shafts disposed on both side walls of the drum-holding frame, are arranged on a common imaginary axis line in parallel with the axis of the photosensitive drum, which is on a common imaginary axis line on the peripheral surface where an image is focused by the exposure means, of the photosensitive drum.

14. A photosensitive drum unit supported between a pair of stationary side walls in an image forming apparatus body, said drum unit comprising:

a drum-holding frame for holding a photosensitive drum, an exposure means-holding frame for holding an exposure means, the exposure means-holding frame being supported on the drum-holding frame so as to move in the axial direction of the photosensitive drum relative to the drum-holding frame, and a pressing means capable of pressing the exposure means-holding frame from one side toward the other side in the axial direction of the photosensitive drum, wherein the exposure means is held by the exposure means-holding frame so as to adjust the position thereof in the radial direction relative to the peripheral surface of the photosensitive drum, wherein both side portions of the exposure means are supported by the exposure means holding frame via a radial direction position adjusting means capable of adjusting the positions thereof in the radial direction relative to the peripheral surface of the photosensitive drum, and wherein each of the radial direction position adjusting means comprises fitting holes formed in the bottom wall portions disposed integrally in the inside of both side portions of the exposure means-holding frame, the fitting holes being such that the ends thereof on the bottom wall side are closed by the closing walls and the other ends thereof are opened, cylindrical portions formed integrally on both side portions of the exposure means and being internally threaded along the inner peripheral surfaces thereof, the cylindrical portions being inserted in the fitting holes from the other ends thereof so as to slide, radial direction position adjusting bolts brought into engagement with the cylindrical portions and into contact at the front ends thereof with the closing walls in the bottom wall portions, and a spring means for urging both side portions of the exposure means toward the bottom wall portions, wherein the fitting holes are so positioned that the axes thereof extend in parallel with each other and at right angles with the axis of the photosensitive drum.

15. A photosensitive drum unit supported between a pair of stationary side walls in an image forming apparatus body, said drum unit comprising:

a drum-holding frame for holding a photosensitive drum, an exposure means-holding frame for holding an exposure means, the exposure means-holding frame being supported on the drum-holding frame so as to move in the axial direction of the photosensitive drum relative to the drum-holding frame, and a pressing means capable of pressing the exposure means-holding frame from one side toward the other side in the axial direction of the photosensitive drum, wherein the pressing means is disposed on one side of the drum-holding frame so as to press the exposure means-holding frame from one side toward the other side in the axial direction of the photosensitive drum, the exposure means-holding frame has one side wall for defining one side of the exposure means-holding frame, the drum-holding frame has a side wall for defining one side of the drum-holding frame, which is positioned on the outer side of one side wall of the exposure means-holding frame, the pressing means comprises a pressing member comprising a cylindrical portion and a closing wall disposed on one side wall of the drum-holding frame so as to move in the axial direction and a compression coil spring disposed between the pressing member and the one side wall of the exposure means-holding frame, and the pressing member is so disposed as to protrude beyond one side wall of the drum-holding frame and is limited at a predetermined position from moving in a direction to separate away from one side wall of the exposure means-holding frame.

16. A photosensitive drum unit according to claim 15, wherein the exposure means comprises an LED head.

* * * * *